US007011721B2

(12) United States Patent
Harris et al.

(10) Patent No.: US 7,011,721 B2
(45) Date of Patent: Mar. 14, 2006

(54) SUPERALLOY FOR SINGLE CRYSTAL TURBINE VANES

(75) Inventors: Kenneth Harris, Spring Lake, MI (US); Jacqueline B. Wahl, Muskegon, MI (US)

(73) Assignee: Cannon-Muskegon Corporation, Muskegon, MI (US)

( * ) Notice: Subject to any disclaimer, the term of this patent is extended or adjusted under 35 U.S.C. 154(b) by 239 days.

(21) Appl. No.: 10/193,878

(22) Filed: Jul. 12, 2002

(65) Prior Publication Data

US 2003/0091459 A1 May 15, 2003

Related U.S. Application Data

(63) Continuation-in-part of application No. 09/797,326, filed on Mar. 1, 2001.

(51) Int. Cl.
*C22C 19/05* (2006.01)

(52) U.S. Cl. ..... 148/428; 420/448

(58) Field of Classification Search ..... 148/428; 420/448

See application file for complete search history.

(56) References Cited

U.S. PATENT DOCUMENTS

| | | | | |
|---|---|---|---|---|
| 4,169,742 A | | 10/1979 | Wukusick et al. | |
| 4,719,080 A | | 1/1988 | Duhl et al. | |
| 4,765,850 A | | 8/1988 | Schweizer | |
| 4,781,772 A | | 11/1988 | Benn et al. | |
| 4,908,183 A | | 3/1990 | Chin et al. | |
| 5,069,873 A | | 12/1991 | Harris et al. | |
| 5,100,484 A | | 3/1992 | Wukusick et al. | |
| 5,154,884 A | | 10/1992 | Wukusick et al. | |
| 5,366,695 A | | 11/1994 | Erickson | |
| 5,470,371 A | | 11/1995 | Darolia | |
| 5,611,670 A | * | 3/1997 | Yoshinari et al. | 416/241 R |
| 5,759,301 A | | 6/1998 | Konter et al. | |
| 5,820,700 A | | 10/1998 | DeLuca et al. | |
| 5,916,382 A | | 6/1999 | Sato et al. | |
| 5,925,198 A | | 7/1999 | Das | |
| 6,051,083 A | | 4/2000 | Tamaki et al. | |
| 6,074,602 A | * | 6/2000 | Wukusick et al. | 420/443 |
| 6,224,695 B1 | | 5/2001 | Kobayashi et al. | |
| 2002/0007877 A1 | | 1/2002 | Mihalisin et al. | |

FOREIGN PATENT DOCUMENTS

| | | |
|---|---|---|
| EP | 1057899 | 12/2000 |

OTHER PUBLICATIONS

Exhibit A is an article entitled "CM 186 LC®Alloy Single Crystal Turbine Vanes", by Phil S. Burkholder, Malcolm C. Thomas, Randy Helmink, Donald J. Frasier, Ken Harris and Jacqueline B. Wahl, published by the American Society of Mechanical Engineers, pp. 1-8, Jun. 7, 1999, International Gas Turbine and Aeroengine Congress & Exhibition, Indianapolis, Indiana.

Exhibit B is an article entitled "New Superalloy Concepts for Single Crystal Turbine Vanes and Blades", by Ken Harris and Jacqueline B. Wahl, published by Cannon-Muskegon Corporation, published Jul. 3, 2000, Parsons 2000, 5th International Charles Parsons Turbine Conference, Churchill College, Cambridge, UK.

* cited by examiner

*Primary Examiner*—Roy King
*Assistant Examiner*—Harry D. Wilkins, III
(74) *Attorney, Agent, or Firm*—Price, Heneveld, Cooper, DeWitt & Litton, LLP

(57) ABSTRACT

A nickel-base superalloy that is useful for making single crystal castings exhibiting outstanding stress-rupture properties, creep-rupture properties, and an increased tolerance for grain defects contains, in percentages by weight, from about 4.7% to about 4.9% chromium, (Cr), from about 9% to about 10% cobalt (Co), from about 0.6% to about 0.8% molybdenum (Mo), from about 8.4% to about 8.8% tungsten (W), from about 4.3% to about 4.8% tantalum (Ta), from about 0.6% to about 0.8% titanium (Ti), from about 5.6% to about 5.8% aluminum (Al), from about 2.8% to about 3.1% rhenium (Re), from about 1.1% to about 1.5% hafnium (Hf), from about 0.06% to about 0.08% carbon (C), from about 0.012% to about 0.020% boron (B), from about 0.004% to about 0.010% zirconium (Zr), the balance being nickel and incidental impurities. The nickel-base superalloy provides improved casting yield and reduce component cost due to a reduction in rejectable grain defects as compared with conventional directionally solidified casting alloys and conventional single crystal alloys.

10 Claims, 14 Drawing Sheets

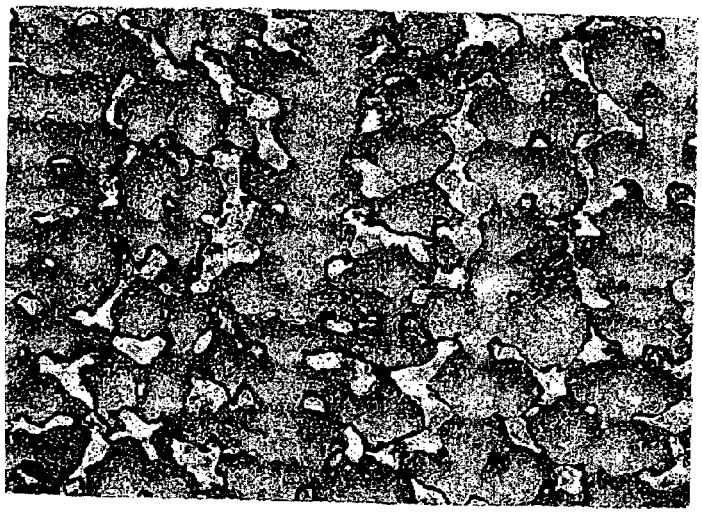
FIG. 9
FIG. 10
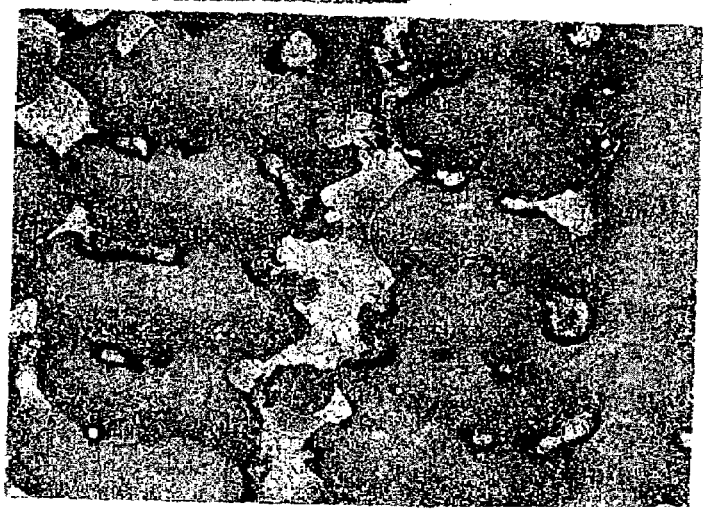
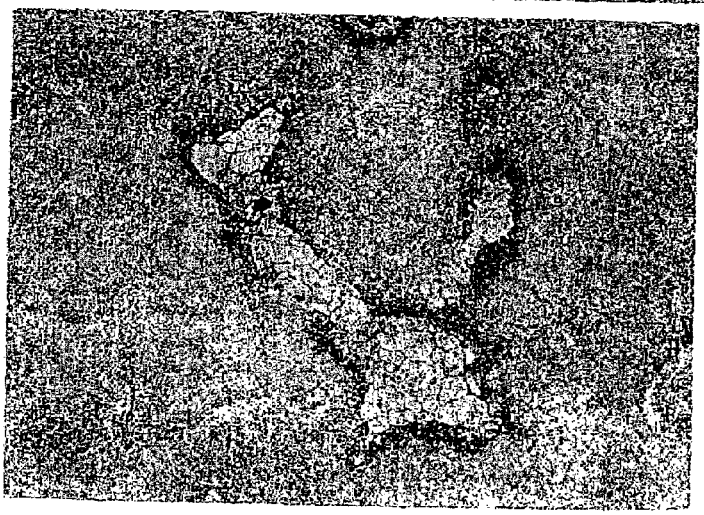
FIG. 11

SUPERALLOY FOR SINGLE CRYSTAL TURBINE VANES

CROSS-REFERENCE TO RELATED APPLICATIONS

This application is a continuation-in-part of U.S. patent application Ser. No. 09/797,326, entitled "SUPERALLOY FOR SINGLE CRYSTAL TURBINE VANES", filed on Mar. 1, 2001, by Kenneth Harris et al., the entire disclosure of which is incorporated herein by reference.

FIELD OF THE INVENTION

This invention relates to superalloys exhibiting superior high temperature mechanical properties, and more particularly to superalloys useful for casting single crystal turbine vanes including vane segments.

BACKGROUND OF THE INVENTION

Single crystal superalloy vanes have demonstrated excellent turbine engine performance and durability benefits as compared with equiaxed polycrystalline turbine vanes. For a detailed discussion see "Allison Engine Testing CMSX-4® Single Crystal Turbine Blades & Vanes," P. S. Burkholder et al., Allison Engine Co., K. Harris et al., Cannon-Muskegon Corp., 3rd Int. Charles Parsons Turbine Conf., Proc. Iom, Newcastle-upon-Tyne, United Kingdom 25–27 April 1995. The improved performance of the single crystal superalloy components is a result of superior thermal fatigue, low cycle fatigue, creep strength, oxidation and coating performance of single crystal superalloys and the absence of grain boundaries in the single crystal vane segments. Single crystal alloys also demonstrate a significant improvement in thin wall (cooled airfoil) creep properties as compared to polycrystalline superalloys. However, single crystal components require narrow limits on tolerance for grain defects such as low angle and high angle boundaries and solution heat treatment-induced recrystallized grains, which reduce casting yield, and as a result, increase manufacturing costs.

Directionally solidified castings of rhenium-containing columnar grain nickel-base superalloys have successfully been used to replace first generation (non-rhenium-containing) single crystal alloys at a cost savings due to higher casting yields. However, directionally solidified components are less advantageous than single crystal vanes due to grain boundaries in non-airfoil regions, particularly at the inner and outer shrouds of multiple airfoil segments exhibiting high, complex stress conditions. Multiple airfoil segments are of growing interest to turbine design engineers due to their potential for lower machining and fabrication costs and reduced hot gas leakage. Increased operating stress and turbine temperatures combined with the demand for reduced maintenance intervals has necessitated the enhanced properties and performance of single crystal rhenium-containing superalloy vane segments.

Thus, there is a recognized need for achieving the benefits of single crystal casting technology while also achieving increased tolerance for grain defects to improve casting yield and reduce component cost.

SUMMARY OF THE INVENTION

The present invention provides a nickel-base superalloy useful for casting multiple vane segments of a turbine in which the vanes and the non-airfoil regions have an increased tolerance for grain defects, whereby improved casting yield and reduced component cost is achievable.

The nickel-base superalloys of this invention exhibit outstanding stress-rupture properties, creep-rupture properties and reduced rejectable grain defects as compared with conventional directionally solidified columnar grain casting alloys and single crystal casting alloys.

The nickel-based superalloys of this invention further exhibit a reduced amount of TCP phase (Re, W, Cr, rich) in the alloy following high temperatures, long term, stressed exposure without adversely affecting alloy properties, such as hot corrosion resistance, as compared with known conventional nickel-based superalloys.

The superalloy compositions of this invention are selected to restrict growth of the γ' precipitate strengthening phase and thus improve intermediate and high temperature stress-rupture properties, ensure predominate formation of relatively stable hafnium carbides (HfC), tantalum carbides (TaC), titanium carbides (TiC) and $M_3B_2$ borides to strengthen grain boundaries and ensure that the alloy is accommodating to both low and high angle boundary grain defects in single crystal castings, and provide good grain boundary strength and ductility.

The superalloys of this invention comprise (in percentages by weight) from about 4.7% to about 4.9% chromium (Cr), from about 9% to about 10% cobalt (Co), from about 0.6% to about 0.8% molybdenum (Mo), from about 8.4% to about 8.8% tungsten (W), from about 4.3% to about 4.8% tantalum (Ta), from about 0.6% to about 0.8% titanium (Ti), from about 5.6% to about 5.8% aluminum (Al), from about 2.8% to about 3.1% rhenium (Re), from about 1.1% to about 1.5% hafnium (Hf), from about 0.06% to about 0.08% carbon (C), from about 0.012% to about 0.020% boron (B), from about 0.004% to about 0.010% zirconium (Zr), the balance being nickel and incidental impurities.

These and other features, advantages, and objects of the present invention will be further understood and appreciated by those skilled in the art by reference to the following specification, claims, and appended drawings.

BRIEF DESCRIPTION OF THE DRAWINGS

FIGS. 9–11 are optical micrographs of single crystal as-cast alloy of this invention;

DESCRIPTION OF PREFERRED EMBODIMENT

Figure 1:
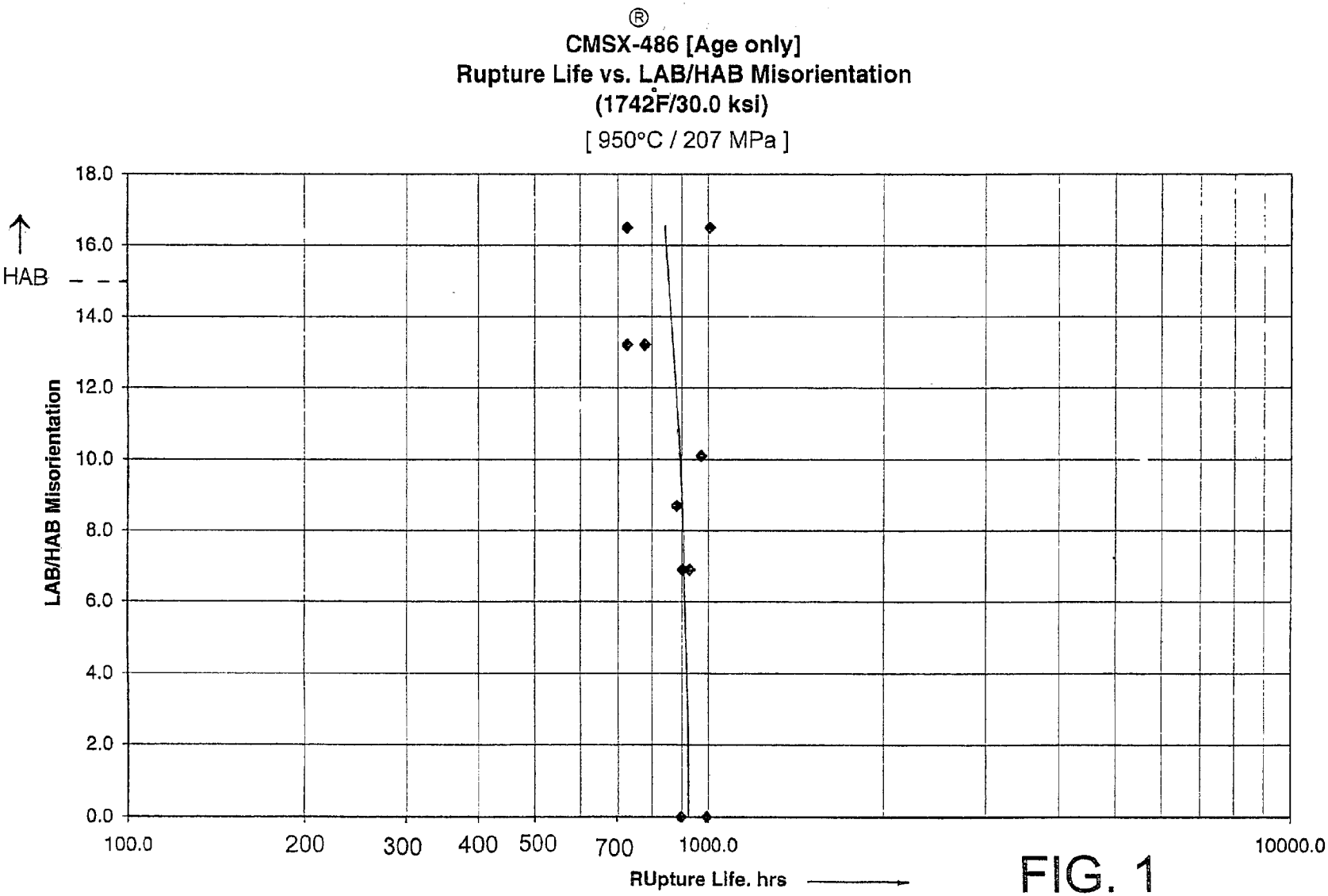
FIGS. 1–8 illustrate stress-rupture life as a function of low angle grain boundary/high angle grain boundary misorientation under various temperature and stress conditions.

The unique ability of the superalloys of this invention to be employed in single crystal casting processes while accommodating low and high angle boundary grain defects is attributable to the relatively narrow compositional ranges defined herein. Single crystal castings made using the superalloys of this invention achieve excellent mechanical properties as exemplified by stress-rupture properties and creep-rupture properties while accommodating low angle grain boundary (less than about 15 degrees) and high angle grain boundary (greater than about 15 degrees) misorientation.

The amounts of the various elements contained in the alloys of this invention are expressed in percentages by weight unless otherwise noted.

The nickel-base superalloys of the preferred embodiments of this invention include, in percentages by weight, from about 4.7% to about 4.9% chromium, from about 9% to about 10% cobalt, from about 0.6% to about 0.8% molybdenum, from about 8.4% to about 8.8% tungsten, from about 4.3% to about 4.8% tantalum, from about 0.6% to about 0.8% titanium, from about 5.6% to about 5.8% aluminum, from about 2.8% to about 3.1% rhenium, from about 1.1% to about 1.5% hafnium, from about 0.06% to about 0.08% carbon, from about 0.012% to about 0.020% boron, from about 0.004% to about 0.010% zirconium, with the balance being nickel and incidental amounts of other elements and/or impurities. The nickel-base superalloys of this invention are useful for achieving the superior thermal fatigue, low cycle fatigue, creep strength, and oxidation resistance for single crystal castings, while accommodating low and high angle boundary grain defects, thus reducing rejectable grain defects and component cost. The nickel-based superalloys of this invention are useful for achieving a reduced amount of TCP phase (Re, W, Cr, rich) in the alloy following high temperatures, long term, stressed exposure without adversely affecting alloy properties, such as hot corrosion resistance, as compared with known conventional nickel-based superalloys.

In accordance with the preferred aspect of the invention there is provided a nickel-base superalloy (CMSX®-486) comprising in percentages by weight, about 4.8% chromium (Cr), about 9.2–9.3% cobalt (Co), about 0.7% molybdenum (Mo), about 8.5–8.6% tungsten (W), about 4.5% tantalum (Ta), about 0.7% titanium (Ti), about 5.6–5.7% aluminum (Al), about 2.9% rhenium (Re), about 1.2–1.3% hafnium (Hf), about 0.07–0.08% carbon (C), about 0.015–0.016% boron (B), about 0.005% zirconium (Zr), the balance being nickel and incidental impurities.

Rhenium (Re) is present in the alloy to slow diffusion at high temperatures, restrict growth of the γ' precipitate strengthening phase, and thus improve intermediate and high temperature stress-rupture properties (as compared with conventional single crystal nickel-base alloys such as CMSX-3® and René N-4). It has been found that about 2.9–3% rhenium provides improved stress-rupture properties without promoting the occurrence of deleterious topologically-close-packed (TCP) phases (Re, W, Cr rich), providing the other elemental chemistry is carefully balanced. The chromium content is preferably from about 4.7% to about 4.9%. This narrower chromium range unexpectedly reduces the amount of TCP phase (Re, W, Cr, rich) in the alloy following high temperature, long term, stressed exposure without adversely affecting alloy properties, such as hot corrosion resistance, as compared with known conventional nickel-based superalloys. Rhenium is known to partition mainly to the γ matrix phase which consists of narrow channels surrounding the cubic γ' phase particles. Clusters of rhenium atoms in the γ channels inhibit dislocation movement and therefore restrict creep. Walls of rhenium atoms at the γ/γ' interfaces restrict γ' growth at elevated temperatures.

An aluminum content at about 5.6–5.7% by weight, tantalum at about 4.5% by weight and titanium at about 0.7% by weight result in about a 70% volume fraction at the cubic γ' coherent precipitate strengthening phase ($Ni_3Al$, Ta, Ti) with low and negative γ–γ' mismatch at elevated temperatures. Tantalum increases the strength of both the γ and γ' phases through solid solution strengthening. The relatively high tantalum and low titanium content, ensure predominate formation of relatively stable tantalum carbides (TaC) to strengthen grain boundaries and therefore ensure that the alloy is accommodating to low and high angle boundary grain defects in single crystal castings. A preferred tantalum content is from about 4.4 to about 4.7%.

Titanium carbides (TiC) tend to dissociate or decompose during high temperature exposure, causing thick γ' envelopes to form around the remaining titanium carbide and precipitation of excessive hafnium carbide (HfC), which lowers grain boundary and γ–γ' eutectic phase region ductility by tying up the desirable hafnium atoms. The best overall results were obtained with an alloy containing about 0.7% titanium. This may be due to the favorable effect of titanium on γ–γ' mismatch. A suitable titanium range is 0.6–0.8%.

Further solid solution strengthening is provided by molybdenum (Mo) at about 0.7% and tungsten (W) at about 8.5–8.6%. A preferred range for tungsten is from about 8.4% to about 8.8%. A suitable range for the molybdenum is from about 0.6% to about 0.8%.

Approximately 50% of the tungsten precipitates in the γ' phase, increasing both the volume fraction ($V_f$) and strength.

Cobalt in an amount of about 9.2–9.3% provides maximized $V_f$ of the γ' phase, and chromium in an amount of about 4.7–4.9% provides acceptable hot corrosion (sulfidation) resistance, while allowing a high level (about 16.7%, e.g., from about 16.4% to about 17.0%) of refractory metal elements (W, Re, Ta, and Mo) in the nickel matrix, without the occurrence of excessive topologically-close-packed phases during stressed, high temperature turbine engine service exposure.

Hafnium (Hf) is present in the alloy at about 1.1–1.5% to provide good grain boundary strength and ductility. This range of Hf ensures good grain boundary (HAB≧15°) mechanical properties when CMSX®-486 is cast as single crystal (SX) components (which can contain grain defects). The alloy is not solution heat treated. The Hf chemistry is critical and Hf is lost particularly in cored (cooled airfoil) castings during the SX solidification process due to reaction with the $SiO_2$ (silica) based ceramic cores. The higher level of Hf content takes into account Hf loss during this casting/solidification process.

Carbon (C), boron (B) and zirconium (Zr) are present in the alloy in amounts of about 0.07–0.08%, 0.015–0.016%, and 0.005%, respectively, to impart the necessary grain boundary microchemistry and carbides/borides needed for low angle grain boundary and high angle grain boundary strength and ductility in single crystal casting form.

The superalloys of this invention may contain trace or trivial amounts of other constituents which do not materially affect their basic and novel characteristics. It is desirable that the following compositional limits are observed: niobium (Nb, also known as columbium) should not exceed 0.10%, vanadium (V) should not exceed 0.05%, sulfur (S) should not exceed 5 ppm, nitrogen (N) should not exceed 5 ppm, oxygen (0) should not exceed 5 ppm, silicon (Si) should not exceed 0.04%, manganese (Mn) should not exceed 0.02%, iron (Fe) should not exceed 0.15%, magnesium (Mg) should not exceed 80 ppm, lanthanum (La) should not exceed 50 ppm, yttrium (Y) should not exceed 50 ppm, cerium (Ce) should not exceed 50 ppm, lead (Pb) should not exceed 1 ppm, silver (Ag) should not exceed 1 ppm, bismuth (Bi) should not exceed 0.2 ppm, selenium (Se) should not exceed 0.5 ppm, tellurium (Te) should not exceed 0.2 ppm, Thallium (Tl) should not exceed 0.2 ppm, tin (Sn) should not exceed 10 ppm, antimony (Sb) should not exceed 2 ppm, zinc (Zn) should not exceed 5 ppm, mercury (Hg) should not exceed 2 ppm, uranium (U) should not exceed 2 ppm, thorium (Th) should not exceed 2 ppm, cadmium (Cd) should not exceed 0.2 ppm, germanium (Ge) should not exceed 1 ppm, gold (Au) should not exceed 0.5 ppm, indium (In) should not exceed 0.2 ppm, sodium (Na) should not exceed 10 ppm, potassium (K) should not exceed 5 ppm, calcium (Ca) should not exceed 50 ppm, platinum (Pt) should not exceed 0.08%, and palladium (Pd) should not exceed 0.05%.

La, Y and Ce can be used individually or in combination up to 50 ppm total to further improve the bare oxidation resistance of the alloy, coating performance including insulative thermal barrier coatings.

The nominal chemistry (typical or target amounts of non-incidental components) of an alloy composition in accordance with the invention (CMSX®-486) is compared with the nominal chemistry of conventional nickel-base superalloys (CM 247 LC®, CMSX-3®, and CM 186 LC®) and an experimental alloy (CMSX®-681) in Table 1.

TABLE 1

| | NOMINAL CHEMISTRY (WT % OR PPM) | | | | | | | | | | | | |
|---|---|---|---|---|---|---|---|---|---|---|---|---|---|
| ALLOY | C | B | Al | Co | Cr | Hf | Mo | Ni | Re | Ta | Ti | W | Zr |
| CM 247 LC ® | .07 | .015 | 5.6 | 9.3 | 8 | 1.4 | .5 | BAL | — | 3.2 | .7 | 9.5 | .010 |
| CMSX-3 ® | 30 ppm | 10 ppm | 5.6 | 4.8 | 8 | .1 | .6 | BAL | — | 6.3 | 1.0 | 8.0 | — |
| **CM 186 LC ® | .07 | .015 | 5.7 | 9.3 | 6 | 1.4 | .5 | BAL | 3 | 3.4 | .7 | 8.4 | .005 |
| CMSX ®-681 | .09 | .015 | 5.7 | 9.3 | 5 | 1.4 | .5 | BAL | 3 | 6.0 | .1 | 8.4 | .005 |
| *CMSX ®-486 | .072 | .016 | 5.69 | 9.2 | 4.8 | 1.26 | .7 | BAL | 2.9 | 4.5 | .7 | 8.5 | .005 |

**Hafnium-containing nickel-base alloy developed for directionally solidified columnar grain turbine airfoils, and described in U.S. Pat. No. 5,069,873, Low Carbon Directional Solidification Alloy, Harris et al. [Cannon Muskegon Corp.].
*The alloy of the claimed invention.

CM 247 LC® is a nickel-base superalloy developed for casting directionally solidified components having a columnar grain structure. CMSX-3® is a low carbon and low boron nickel-base superalloy developed for casting single crystal components exhibiting superior strength and durability. However, single crystal components cast from CMSX-3® are produced at a significantly higher cost due to lower casting and solution heat treatment yields which are a result of rejectable grain defects. CM 186 LC® is a rhenium-containing nickel-base superalloy developed to contain optimum amounts of carbon (C), boron (B), hafnium (Hf) and zirconium (Zr), and consequent carbide and boride grain boundary phases that achieve an excellent combination of mechanical properties and higher yields in directionally solidified columnar grain components and single crystal components such as turbine airfoils. CMSX®-681 is an experimental nickel-base superalloy conceived as an alloy with improved creep strength as compared with single crystal CM 186 LC® alloy. CMSX®-486 is a nickel-base superalloy (in accordance with the invention) that is compositionally similar to CM-186 LC® and CMSX®-681. However, single crystal castings of CMSX®-486 alloy exhibit surprisingly superior stress-rupture properties and creep-rupture properties as compared with single crystal castings of CMSX®-681 alloy.

Stress-rupture properties were evaluated by casting test bars from each of the alloys (CM-247 LC®, CMSX-3®, CM 186 LC®, CMSX®-681 and CMSX®-486) and appropriately heat treating and/or aging the test bars, and subsequently subjecting specimens (test bars) prepared from each of the alloys to a constant load at a selected temperature. Stress-rupture properties were characterized by their typical life (average time to rupture, measured in hours). The directionally solidified CM 247 LC® test bars were partial solution heat treated for two hours at 2230° F., two hours at 2250° F. and two hours at 2270° F., and two hours at 2280–2290° F., air cooled or gas fan quenched, aged for four hours at 1975° F., air cooled or gas fan quenched, aged 20 hours at 1600° F., and air cooled. The CM 186 LC®, CMSX®-681 and CMSX®-486 test bars were as-cast + double aged by aging for four hours at 1975° F., air cooling or gas fan quenching, aging for 20 hours at 1600° F., and air cooling. The CMSX-3® test bars were solutioned for 3 hours at 2375° F., air cooled or gas fan quenched + double aged 4 hours at 1975° F., air cooled or gas fan quenched +20 hours at 1600° F. Stress-rupture properties at 36 ksi and 1800° F. (248 MPa at 982° C.), 25 ksi at 1900° F. (172 MPa at 1038° C.), and 12 ksi at 2000° F. (83 MPa at 1092° C.) are shown in Table 2, Table 3, and Table 4, respectfully.

TABLE 2

| STRESS-RUPTURE PROPERTIES 36.0 ksi/1800° F. [248 MPa/982° C.] | | |
|---|---|---|
| ALLOY | ORIENTATION/ HEAT TREATMENT | TYPICAL LIFE HRS [AVERAGE OF AT LEAST 2 SPECIMENS] |
| DS CM 247 LC ® | DS LONGITUDINAL 98% + SOLN. GFQ + DOUBLE AGE | 43 |
| CMSX-3 ® | SX WITHIN 10° of (001) 98% + SOLN. GFQ + DOUBLE AGE | 80 |
| CM 186 LC ® | SX WITHIN 10° OF (001) AS-CAST + DOUBLE AGE | 100 |
| CMSX ®-681 | SX WITHIN 10° OF (001) AS-CAST + DOUBLE AGE | 113 |
| *CMSX ®-486 | SX WITHIN 10° OF (001) AS-CAST + DOUBLE AGE | 141 |

*The alloy of this claimed invention.

TABLE 3

STRESS-RUPTURE PROPERTIES
25.0 ksi/1900° F. [172 MPa/1038° C.]

| ALLOY | ORIENTATION/ HEAT TREATMENT | TYPICAL LIFE HRS [AVERAGE OF AT LEAST 2 SPECIMENS] |
|---|---|---|
| DS CM 247 LC ® | DS LONGITUDINAL 98% + SOLN. GFQ + DOUBLE AGE | 35 |
| CMSX-3 ® | SX WITHIN 10° of (001) 98% + SOLN. GFQ + DOUBLE AGE | 104 |
| CM 186 LC ® | SX WITHIN 10° OF (001) AS-CAST + DOUBLE AGE | 85 |
| *CMSX ®-486 | SX WITHIN 10° OF (001) AS-CAST + DOUBLE AGE | 112 |

*The alloy of this claimed invention.

TABLE 4

STRESS-RUPTURE PROPERTIES
12.0 ksi/2000° F. [83 MPa/1093° C.]

| ALLOY | ORIENTATION/ HEAT TREATMENT | TYPICAL LIFE HRS [AVERAGE OF AT LEAST 2 SPECIMENS] |
|---|---|---|
| DS CM 247 LC ® | DS LONGITUDINAL 98% + SOLN. GFQ + DOUBLE AGE | 161 |
| CMSX-3 ® | SX WITHIN 10° of (001) 98% + SOLN. GFQ + DOUBLE AGE | 1020 |
| CM 186 LC ® | SX WITHIN 10° OF (001) AS-CAST + DOUBLE AGE | 460 |
| CMSX ®-681 | SX WITHIN 10° OF (001) AS-CAST + DOUBLE AGE | 528 |
| *CMSX ®-486 | SX WITHIN 10° OF (001) AS-CAST + DOUBLE AGE | 659 |

*The alloy of this claimed invention.

The results show that the CMSX®-486 test bars exhibited significantly improved stress-rupture properties under a load of 36 ksi at 1800° F. as compared with the conventional alloys and the experimental alloy CMSX®-681. Under a load of 25 ksi at 1900° F., the CMSX®-486 test bars (in accordance with the invention) perform significantly better than the directionally solidified CM 247 LC® and single crystal (SX) CM 186 LC® test bars, and similar to the CMSX-3® test bars. However, single crystal castings of CMSX®-486 can be produced at a considerable cost savings as compared with single crystal castings of CMSX-3® because of fewer rejectable grain defects. Further, the CMSX®-486 components exhibit excellent stress-rupture properties as-cast, whereas the CMSX-3® components require solution heat treatment. Under a 12 ksi load at 2000° F., the CMSX®-486 test bars exhibited significantly improved stress-rupture properties as compared with directionally solidified CM 247 LC® and single crystal CM 186 LC® test bars, as well as the experimental CMSX®-681 test bars. Under a load of 12 ksi at 2000° F., the CMSX®-486 test bars (in accordance with the invention) have a typical life that was approximately 65% of the typical life of the CMSX-3® test bars. However, on account of fewer rejectable grain defects, it has been estimated that single crystal components cast from CMSX®-486 alloy (as-cast) will have a cost that is approximately half that of single crystal components cast from CMSX-3® alloy (solution heat treated). Accordingly, it is possible that components cast of CMSX®-486 alloy will have very significant cost advantages over single crystal components cast from CMSX-3® alloy, even at application temperatures as high as 2000° F.

Another set of test bars cast from CMSX®-486 alloy were subjected to creep-rupture tests. A portion of the test bars were partial solution heat treated and double aged, and another portion of the test bars were double aged as-cast. The partial solution heat treatment was carried out for one hour at 2260° F., one hour at 2270° F., and one hour at 2280° F., followed by air-cooling and gas fan quenching. The double aging included four hours at 1975° F. followed by air cooling and gas fan quenching, and 20 hours at 1600° F. followed by air cooling. The specimens were subjected to a selected constant load at a selected temperature. The time to 1% creep (elongation), the time to 2% creep, and the time to rupture (life) were measured for specimens under each of the selected test conditions. The percent elongation at rupture and the reduction in area at rupture were also measured for specimens under each of the selected test conditions. The results of the creep-rupture tests are summarized in Table 5.

TABLE 5

CREEP-RUPTURE PROPERTIES (TYPICAL)
CMSX ®-486 [SX WITHIN 10° OF (001)]

| TEST CONDITION | HEAT TREATMENT | TIME TO 1.0% CREEP HRS. | TIME TO 2.0% CREEP HRS. | LIFE HRS. | ELONG % AD | RA % |
|---|---|---|---|---|---|---|
| 36.0 ksi/1800° F. [248 MPa/982° C.] | Partial Soln. + Double Age | 51.7 | 74.8 | 168.1 | 39.7 | 47.0 |
| | | 56.4 | 80.9 | 172.0 | 35.4 | 45.1 |
| | As-Cast + Double Age | 48.0 | 66.3 | 143.0 | 35.7 | 48.1 |
| | | 42.9 | 61.0 | 138.3 | 46.1 | 47.0 |
| 25.0 ksi/1900° F. [172 MPa/1038° C.] | Partial Soln. + Double Age | 39.4 | 59.8 | 114.3 | 28.4 | 52.5 |
| | As-Cast + Double Age | 39.5 | 57.8 | 119.2 | 41.7 | 49.2 |
| | | 37.3 | 56.1 | 110.9 | 16.1 | 17.2 |
| 12.0 ksi/2000° F. [83 MPa/1093° C.] | Partial Soln. + Double Age | 218.7 | 315.9 | 472.0 | 33.9 | 36.1 |
| | | 145.8 | 289.1 | 474.2 | 35.2 | 43.4 |
| | As-Cast + Double Age | 357.7 | 462.1 | 643.9 | 33.0 | 37.0 |
| | | 360.2 | 495.5 | 673.9 | 25.4 | 40.0 |

Partial Soln: 1 hr/2260° F. + 1 hr/2270° F. + 1 hr/2280° F. AC/GFQ
Double Age: 4 hr/1975° F. AC/GFQ [1080° C.] + 20 hrs/1600° F. AC [871° C.]

The results demonstrate that single crystal castings from CMSX®-486 alloys have excellent creep-rupture properties and ductility. The results also show that unlike conventional nickel-base superalloys, single crystal components cast from CMSX®-486 alloy exhibit better creep-rupture properties as-cast, under certain conditions, than when partial solution heat treated. (See 2000° F./12.0 ksi: data Table 5.) More specifically, the data suggests that partial solution heat treatment of CMSX®-486 castings is detrimental to creep-rupture properties when the components are stressed at 2000° F. At 1900° F., partial solution heat treatment does not affect creep-rupture properties significantly, and at 1800° F., partial solution heat treatment has only a slight beneficial effect. The results suggest that as-cast + double aged single crystal components may be beneficially employed in many applications.

Molds were seeded to produce bi-crystal test slabs from CMSX®-486 alloy that intentionally have a low angle boundary (LAB) and/or high angle boundary (HAB) grain defects. The slabs were grain etched in the as-cast condition and inspected to determine the actual degree of misorientation obtained. The test slabs were double aged and subject to creep-rupture testing as described above. The results are set forth in Table 6.

TABLE 6

CMSX ®-486 Bi-XL Slab Creep-Rupture Test Matrix [VG 428/VG 433] (Double Age Only)

| ID | LAB/HAB (Degrees) | TEST CONDITION | RUPTURE LIFE HRS | ELONG., % | RA % | Time to 1% | Time to 2% |
|---|---|---|---|---|---|---|---|
| B742-4 | SX-long | 1742F./30.0 ksi | 996.6 | 44.4 | 49.5 | 392.9 | 498.8 |
| C741 | SX-long | 1742F./30.0 ksi | 900.1 | 34.6 | 50.8 | 347.9 | 454.1 |
| 276-2 | 6.9 | 1742F./30.0 ksi | 904.3 | 52.5 | 51.0 | 318.6 | 421.1 |
| 276-6 | 6.9 | 1742F./30.0 ksi | 929.7 | 47.6 | 50.1 | 352.1 | 460.7 |
| 257-4 | 8.7 | 1742F./30.0 ksi | 883.5 | 26.5 | 23.5 | 306.1 | 419.0 |
| 257-8 | 8.7 | 1742F./30.0 ksi | 909.3 | 22.0 | 20.7 | 320.3 | 436.8 |
| 268-1 | 10.1 | 1742F./30.0 ksi | 919.0 | 51.7 | 50.0 | 339.0 | 435.7 |
| 268-5 | 10.1 | 1742F./30.0 ksi | 973.3 | 19.1 | 17.5 | 420.5 | 542.9 |
| 266-1 | 13.2 | 1742F./30.0 ksi | 726.9 | 11.6 | 12.3 | 310.6 | 414.7 |
| 266-5 | 13.2 | 1742F./30.0 ksi | 779.2 | 16.9 | 16.9 | 306.4 | 407.2 |
| 274.1 | 16.5 | 1742F./30.0 ksi | 727.1 | 12.5 | 14.3 | 319.6 | 416.5 |
| 247-3 | 16.5 | 1742F./30.0 ksi | 1009.8 | 12.0 | 12.2 | 504.5 | 629.4 |
| O742 | SX-long | 1742F./36.0 ksi | 267.1 | 36.9 | 52.2 | 118.2 | 149.7 |
| 276-1 | 6.9 | 1742F./36.0 ksi | 400.5 | 45.1 | 48.2 | 135.6 | 184.0 |
| 276-5 | 6.9 | 1742F./36.0 ksi | 381.4 | 15.3 | 14.1 | 150.5 | 205.0 |
| 257-3 | 8.7 | 1742F./36.0 ksi | 405.7 | 19.7 | 19.2 | 147.9 | 199.6 |
| 257-7 | 8.7 | 1742F./36.0 ksi | 413.7 | 20.6 | 22.1 | 160.9 | 215.8 |
| 268-2 | 10.1 | 1742F./36.0 ksi | 411.3 | 15.7 | 15.5 | 158.5 | 302.8 |
| 268-6 | 10.1 | 1742F./36.0 ksi | 314.5 | 10.3 | 10.2 | 131.6 | 179.0 |
| 266-2 | 13.2 | 1742F./36.0 ksi | 344.7 | 14.0 | 11.8 | 131.6 | 179.3 |
| 266-6 | 13.2 | 1742F./36.0 ksi | 357.2 | 20.6 | 17.3 | 117.3 | 169.8 |
| 274-2 | 16.5 | 1742F./36.0 ksi | 339.0 | 12.2 | 12.8 | 138.6 | 193.5 |
| 274-4 | 16.5 | 1742F./36.0 ksi | 348.9 | 10.8 | 12.4 | 147.7 | 201.1 |
| K742 | SX-long | 1800F./25.0 ksi | 727.3 | 50.1 | 51.4 | 273.2 | 372.6 |
| L742 | SX-long | 1800F./25.0 ksi | 522.4 | 48.4 | 56.0 | 196.2 | 269.3 |
| 264-3 | 4.7 | 1800F./25.0 ksi | 720.1 | 46.3 | 55.5 | 267.8 | 348.8 |
| 264-6 | 4.7 | 1800F./25.0 ksi | 736.8 | 46.2 | 49.7 | 269.3 | 472.4 |
| 257-1 | 8.7 | 1800F./25.0 ksi | 639.4 | 18.6 | 22.5 | 225.9 | 323.6 |
| 257-5 | 8.7 | 1800F./25.0 ksi | 712.5 | 40.4 | 21.5 | 262.1 | 349.1 |
| 270-4 | 10.1 | 1800F./25.0 ksi | 739.7 | 40.8 | 55.0 | 283.6 | 377.5 |
| 270-8 | 10.0 | 1800F./25.0 ksi | 810.8 | 39.6 | 49.0 | 325.8 | 423.7 |
| 260-1 | 11.9 | 1800F./25.0 ksi | 604.8 | 19.6 | 17.4 | 233.9 | 321.3 |
| 260-5 | 11.9 | 1800F./25.0 ksi | 609.1 | 11.9 | 14.9 | 266.9 | 366.2 |
| 275-7 | 13.8 | 1800F./25.0 ksi | 551.6 | 10.3 | 8.9 | 264.9 | 357.5 |
| 275-3 | 13.8 | 1800F./25.0 ksi | 548.5 | 10.2 | 11.5 | 245.2 | 332.8 |
| 265-1 | 18.1 | 1800F./25.0 ksi | 1.0** | 0.9 | 1.0 | — | — |
| 265-5 | 18.1 | 1800F./25.0 ksi | 693.2 | 47.9 | 52.1 | 248.3 | 340.6 |
| J742 | SX-long | 1800F./30.0 ksi | 246.8 | 33.8 | 52.9 | 82.2 | 116.3 |
| E741 | SX-long | 1800F./30.0 ksi | 233.8 | 40.3 | 50.1 | 89.0 | 119.3 |
| 264-2 | 4.7 | 1800F./30.0 ksi | 316.7 | 37.1 | 51.6 | 99.4 | 141.0 |
| 264-5 | 4.7 | 1800F./30.0 ksi | 317.7 | 36.1 | 46.0 | 102.7 | 144.3 |
| 257-2 | 8.7 | 1800F./30.0 ksi | 273.0 | 17.6 | 16.5 | 83.1 | 125.8 |
| 257-6 | 8.7 | 1800F./30.0 ksi | 280.5 | 23.0 | 17.0 | 112.3 | 141.4 |
| 270-3 | 10.0 | 1800F./30.0 ksi | 239.3 | 7.9 | 8.4 | 134.3 | 176.2 |
| 270-7 | 10.0 | 1800F./30.0 ksi | 381.9 | 35.6 | 36.1 | 155.7 | 200.5 |
| 260-2 | 11.9 | 1800F./30.0 ksi | 273.0 | 13.4 | 13.6 | 107.0 | 149.3 |
| 260-6 | 11.9 | 1800F./30.0 ksi | 273.6 | 13.1 | 13.7 | 113.7 | 151.2 |
| 275-4 | 13.8 | 1800F./30.0 ksi | 244.1 | 7.6 | 8.1 | 114.8 | 155.0 |
| 275-8 | 13.8 | 1800F./30.0 ksi | 281.7 | 16.1 | 19.0 | 99.9 | 152.5 |
| 265-2 | 18.1 | 1800F./30.0 ksi | 190.6 | 3.8 | 3.5 | 126.3 | 171.1 |
| 265-6 | 18.1 | 1800F./30.0 ksi | 270.1 | 5.8 | 5.7 | 155.0 | 202.4 |
| A722 | SX-long | 1800F./36.0 ksi | 143.0 | 35.7 | 48.1 | 48.0 | 66.3 |
| K720 | SX-long | 1800F./36.0 ksi | 138.3 | 46.1 | 47.0 | 42.9 | 61.0 |
| 264-1 | 4.7 | 1800F./36.0 ksi | 136.4 | 40.3 | 47.5 | 38.5 | 56.2 |
| 264-4 | 4.7 | 1800F./36.0 ksi | 141.1 | 49.0 | 46.8 | 43.1 | 60.8 |
| 258-4 | 7.7 | 1800F./36.0 ksi | 141.5 | 22.9 | 24.3 | 42.9 | 62.9 |
| 258-8 | 7.7 | 1800F./36.0 ksi | 141.3 | 28.8 | 29.8 | 42.5 | 60.6 |

TABLE 6-continued

CMSX ®-486 Bi-XL Slab Creep-Rupture Test Matrix [VG 428/VG 433] (Double Age Only)

| ID | LAB/HAB (Degrees) | TEST CONDITION | RUPTURE LIFE HRS | ELONG., % | RA % | Time to 1% | Time to 2% |
|---|---|---|---|---|---|---|---|
| 270-1 | 10.0 | 1800F./36.0 ksi | 133.4 | 34.4 | 47.7 | 43.4 | 61.5 |
| 270-5 | 10.0 | 1800F./36.0 ksi | 152.5 | 45.1 | 45.0 | 50.1 | 70.0 |
| 260-3 | 11.9 | 1800F./36.0 ksi | 120.1 | 26.7 | 33.9 | 34.9 | 52.1 |
| 260-7 | 11.9 | 1800F./36.0 ksi | 113.9 | 8.5 | 9.7 | 53.3 | 73.7 |
| 275-2 | 13.8 | 1800F./36.0 ksi | 101.8 | 9.0 | 8.0 | 41.3 | 59.6 |
| 275-6 | 13.8 | 1800F./36.0 ksi | 103.4 | 8.5 | 14.9 | 46.1 | 64.9 |
| 272-3 | 14.4 | 1800F./36.0 ksi | 117.6 | 14.7 | 13.8 | 42.5 | 60.3 |
| 272-6 | 14.4 | 1800F./36.0 ksi | 123.7 | 10.2 | 14.2 | 54.0 | 73.3 |
| 265-3 | 18.1 | 1800F./36.0 ksi | 70.9 | 4.7 | 3.7 | 35.5 | 57.9 |
| 265-7 | 18.1 | 1800F./36.0 ksi | 83.7 | 4.0 | 4.1 | 63.8 | 79.9 |
| 276-3 | 6.9 | 1900F./15.5 ksi | 931.9 | 11.5 | 16.2 | 448.7 | 614.4 |
| 726-7 | 6.9 | 1900F./15.5 ksi | 1092.4 | 36.6 | 52.5 | 440.2 | 628.5 |
| 263-1 | 9.4 | 1900F./15.5 ksi | 842.7 | 16.2 | 22.8 | 356.4 | 525.3 |
| 263-5 | 9.4 | 1900F./15.5 ksi | 871.0 | 32.5 | 51.8 | 420.3 | 537.5 |
| 268-3 | 10.1 | 1900F./15.5 ksi | 1096.8 | 11.0 | 13.3 | 531.4 | 763.0 |
| 268-7 | 10.1 | 1900F./15.5 ksi | 1177.8 | 7.2 | 8.9 | 584.5 | 855.0 |
| 256-1 | 12.3 | 1900F./15.5 ksi | 887.3 | 8.7 | 8.2 | 483.5 | 619.8 |
| 256-3 | 12.3 | 1900F./15.5 ksi | 840.2 | 7.4 | 7.3 | 437.1 | 618.5 |
| 272-2 | 14.4 | 1900F./15.5 ksi | 1019.2 | 9.9 | 13.1 | 492.7 | 723.0 |
| 272-5 | 14.4 | 1900F./15.5 ksi | 894.6 | 7.8 | 5.2 | 330.0 | 626.5 |
| 278-3 | 22.1 | 1900F./15.5 ksi | 763.5 | 3.9 | 3.5 | 501.2 | 683.8 |
| 276-4 | 6.9 | 1900F./25.0 ksi | 104.8 | 46.3 | 53.3 | 32.1 | 48.1 |
| 276-8 | 6.9 | 1900F./25.0 ksi | 119.2 | 41.7 | 49.2 | 39.5 | 57.8 |
| 263-2 | 9.4 | 1900F./25.0 ksi | 112.7 | 20.3 | 21.5 | 39.1 | 56.0 |
| 263-6 | 9.4 | 1900F./25.0 ksi | 110.9 | 16.1 | 17.2 | 37.3 | 56.1 |
| 268-4 | 10.1 | 1900F./25.0 ksi | 104.2 | 11.0 | 8.9 | 42.9 | 61.3 |
| 268-8 | 10.1 | 1900F./25.0 ksi | 86.1 | 9.1 | 11.0 | 36.5 | 53.9 |
| 256-2 | 12.3 | 1900F./25.0 ksi | 82.0 | 9.6 | 8.3 | 41.9 | 60.1 |
| 256-4 | 12.3 | 1900F./25.0 ksi | 74.9 | 9.8 | 8.7 | 29.2 | 43.5 |
| 272-1 | 14.4 | 1900F./25.0 ksi | 80.6 | 10.1 | 13.2 | 33.9 | 48.7 |
| 272-4 | 14.4 | 1900F./25.0 ksi | 74.7 | 9.7 | 10.6 | 31.1 | 45.6 |
| 278-2 | 22.1 | 1900F./25.0 ksi | 1.4** | 1.2 | 0.7 | — | — |
| 278-4 | 22.1 | 1900F./25.0 ksi | 70.9 | 5.3 | 4.6 | 35.2 | 52.2 |
| B722 | SX-long | 1922F./17.4 ksi | 416.7 | 36.7 | 50.2 | 122.5 | 210.5 |
| M720 | SX-long | 1922F./17.4 ksi | 370.6 | 24.4 | 44.6 | 137.5 | 204.1 |
| 258-1 | 7.7 | 1922F./17.4 ksi | 314.4 | 25.3 | 51.2 | 116.1 | 175.0 |
| 258-7 | 7.7 | 1922F./17.4 ksi | 455.7 | 10.8 | 13.8 | 186.2 | 283.8 |
| 270-2 | 10.0 | 1922F./17.4 ksi | 455.1 | 33.8 | 36.7 | 193.0 | 273.2 |
| 270-6 | 10.0 | 1922F./17.4 ksi | 554.4 | 37.7 | 50.1 | 239.3 | 337.7 |
| 260-4 | 11.9 | 1922F./17.4 ksi | 368.9 | 8.1 | 11.3 | 193.1 | 267.5 |
| 260-8 | 11.9 | 1922F./17.4 ksi | 442.7 | 31.6 | 47.3 | 166.1 | 246.4 |
| 275-1 | 13.8 | 1922F./17.4 ksi | 340.7 | 8.4 | 7.7 | 167.0 | 245.2 |
| 275-5 | 13.8 | 1922F./17.4 ksi | 315.5 | 5.8 | 10.6 | 156.0 | 229.3 |
| 265-4 | 18.1 | 1922F./17.4 ksi | 300.0 | 3.8 | 3.5 | 221.6 | 296.8 |
| 265-8 | 18.1 | 1922F./17.4 ksi | 234.1 | 3.0 | 2.9 | 188.1 | — |
| 258-2 | 7.7 | 2000F./9.0 ksi | 1377.7 | 6.2 | 9.6 | 1095.3 | 1237.3 |
| 258-5 | 7.7 | 2000F./9.0 ksi | 1620.3 | 9.2 | 11.7 | 965.6 | 1313.6 |
| 263-3 | 9.4 | 2000F./9.0 ksi | 1552.5 | 5.7 | 10.3 | 1301.1 | 1433.4 |
| 263-7 | 9.4 | 2000F./9.0 ksi | 781.1 | 4.9 | 9.5 | 559.6 | 726.1 |
| 255-1 | 11.3 | 2000F./9.0 ksi | 1451.7 | 4.7 | 7.9 | 911.6 | 1285.0 |
| 255-3 | 11.3 | 2000F./9.0 ksi | 1366.0 | 6.0 | 6.9 | 1162.5 | 1252.0 |
| 266-3 | 13.2 | 2000F./9.0 ksi | 1073.0 | 2.3 | 2.8 | — | — |
| 266-7 | 13.2 | 2000F./9.0 ksi | 1024.6 | 3.1 | 2.5 | — | — |
| 273-2 | 17.4 | 2000F./9.0 ksi | 646.0 | 0.9 | 0.7 | — | — |
| 273-4 | 17.4 | 2000F./9.0 ksi | 825.6 | 2.7 | 1.7 | — | — |
| C722 | SX-long | 2000F./12.0 ksi | 643.9 | 33.0 | 37.0 | 357.7 | 462.1 |
| N720 | SX-long | 2000F./12.0 ksi | 673.9 | 25.4 | 40.0 | 360.2 | 495.5 |
| 258-3 | 7.7 | 2000F./12.0 ksi | 499.3 | 7.0 | 9.8 | 345.5 | 419.5 |
| 258-6 | 7.7 | 2000F./12.0 ksi | 484.9 | 3.0 | 5.1 | 125.5 | 389.2 |
| 263-4 | 9.4 | 2000F./12.0 ksi | 532.2 | 11.4 | 11.6 | 335.5 | 502.9 |
| 263-8 | 9.4 | 2000F./12.0 ksi | 414.9 | 5.1 | 7.7 | 255.9 | 349.9 |
| 255-2 | 11.3 | 2000F./12.0 ksi | 533.7 | 5.8 | 6.0 | 338.8 | 449.6 |
| 255-4 | 11.3 | 2000F./12.0 ksi | 491.1 | 5.8 | 6.0 | 286.5 | 401.4 |
| 266-4 | 13.2 | 2000F./12.0 ksi | 355.5 | 2.7 | 2.6 | 346.8 | — |
| 266-8 | 13.2 | 2000F./12.0 ksi | 360.2 | 1.8 | 1.7 | 270.7 | — |
| 273-1 | 17.4 | 2000F./12.0 ksi | 0.2** | 1.4 | 0.8 | — | — |
| 273-3 | 17.4 | 2000F./12.0 ksi | 169.1 | 0.6 | 0.3 | — | — |

**Probable specimen defect.

Figure 2:
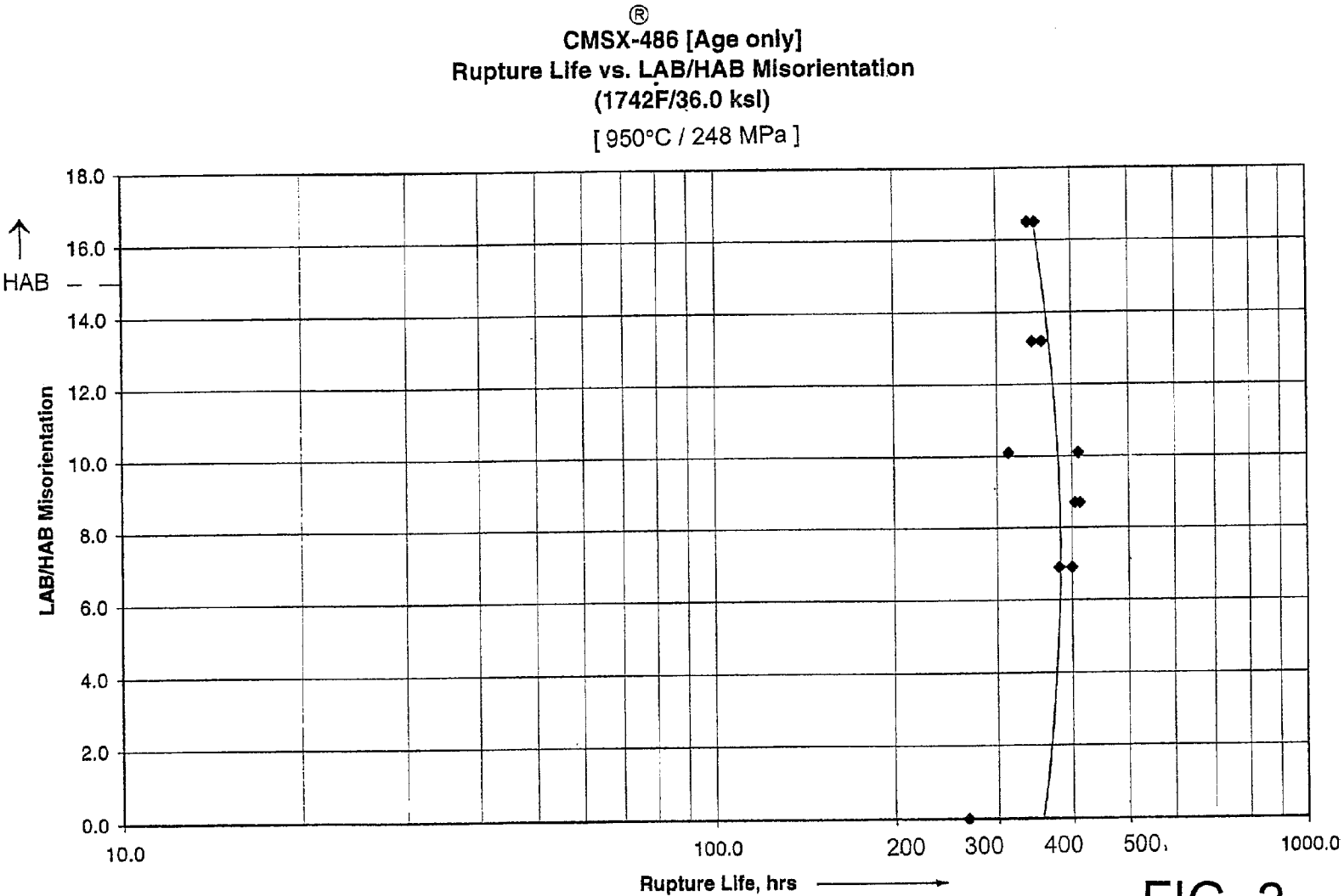
Figure 3:
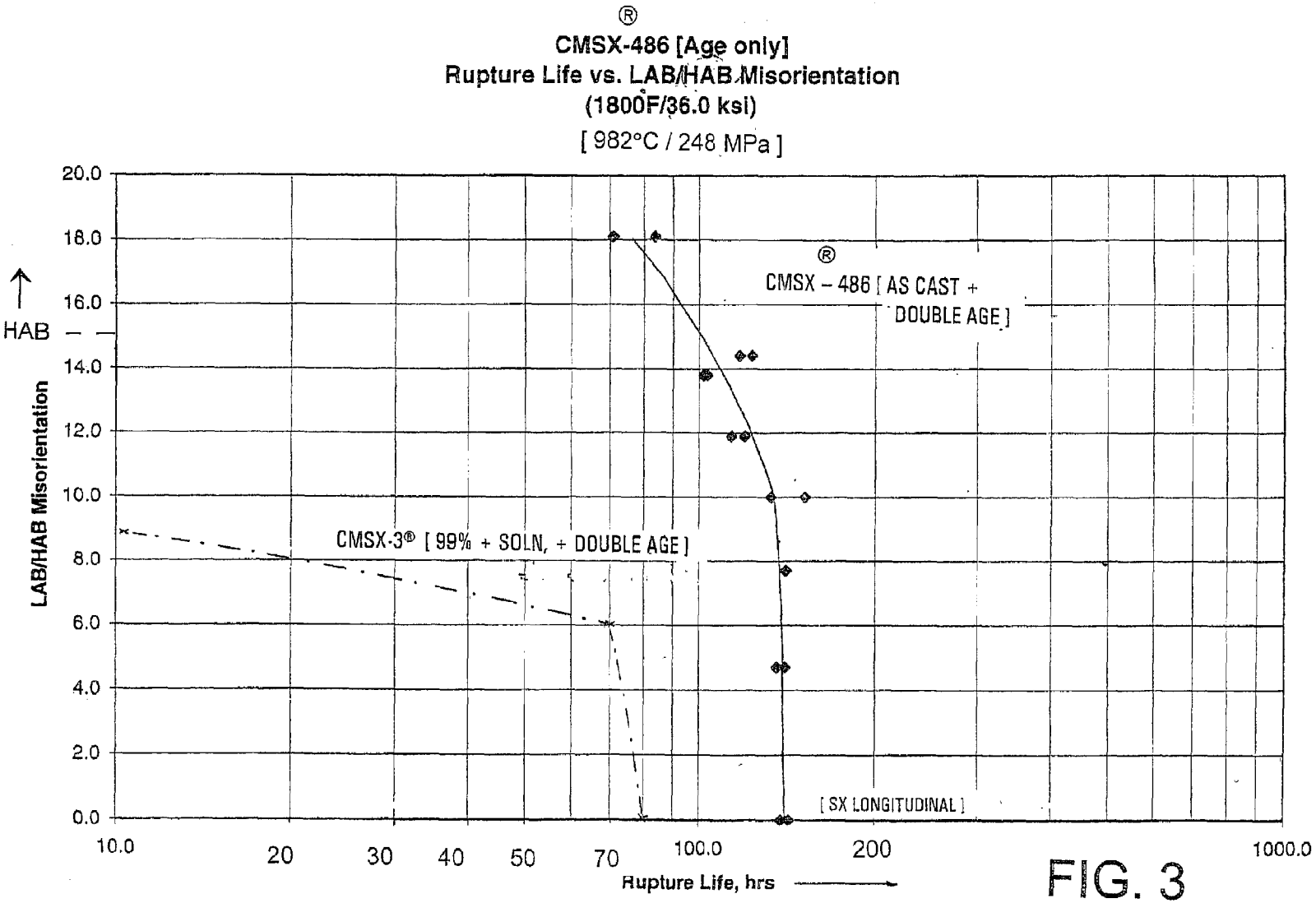
Figure 4:
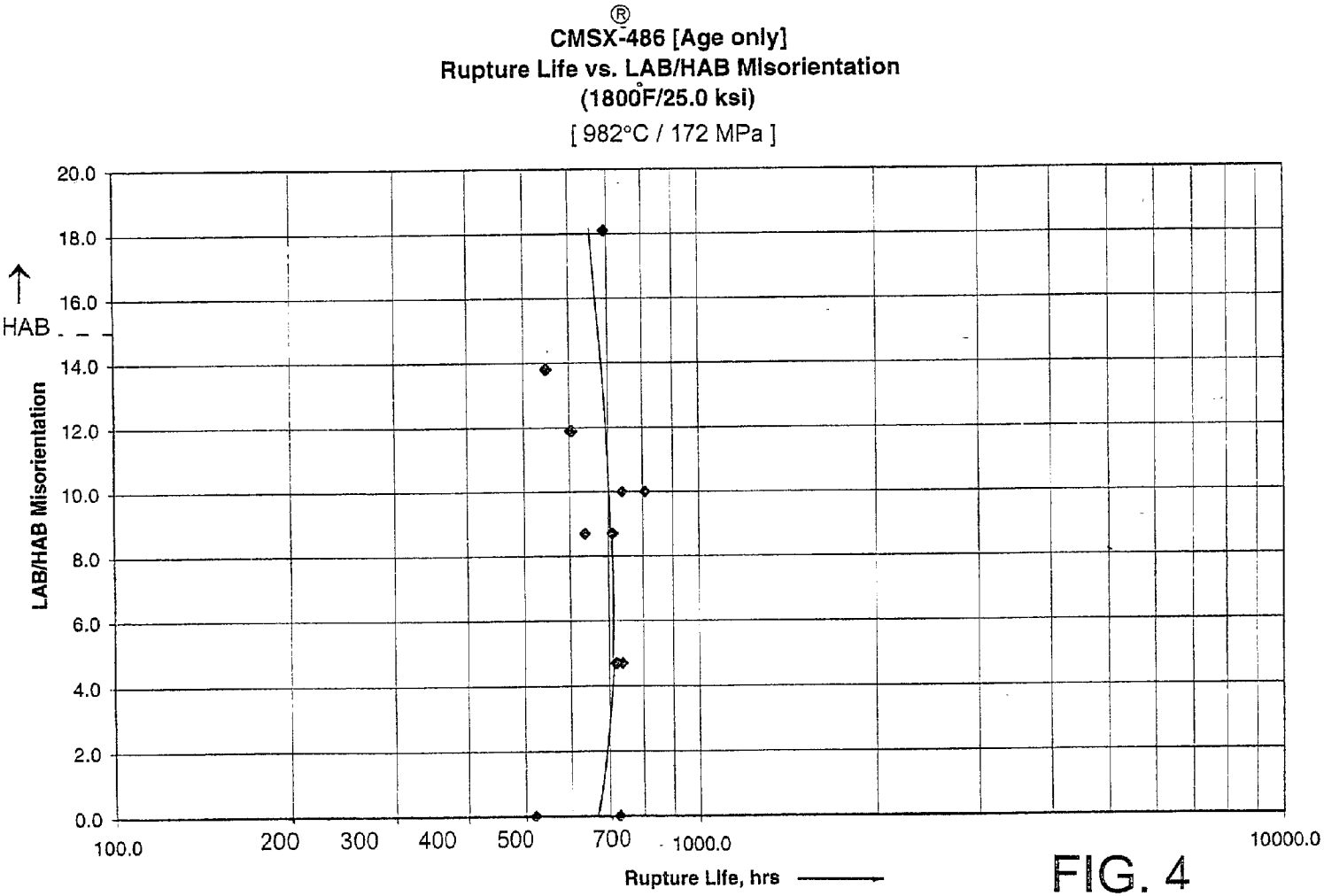
Figure 5:
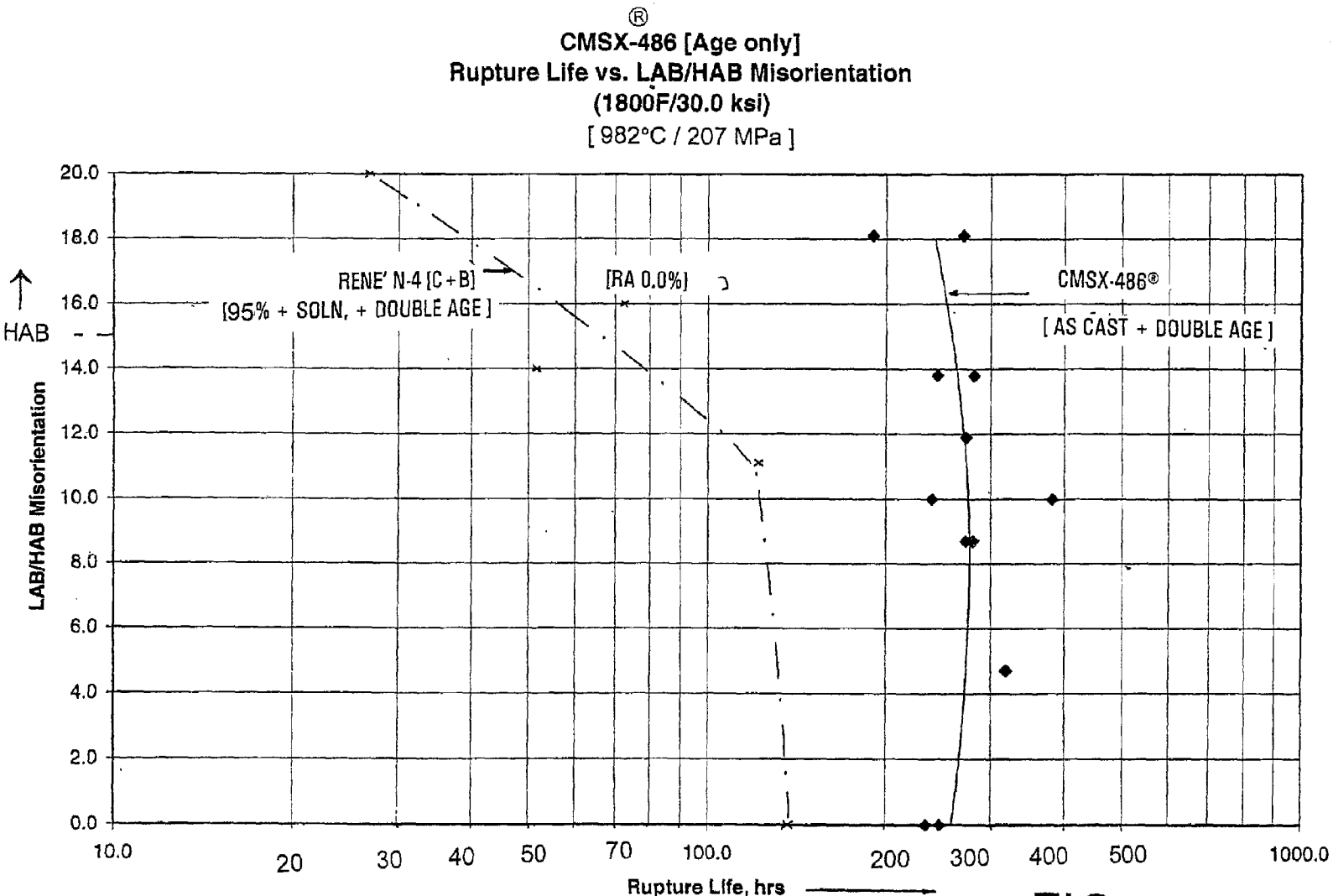
Figure 6:
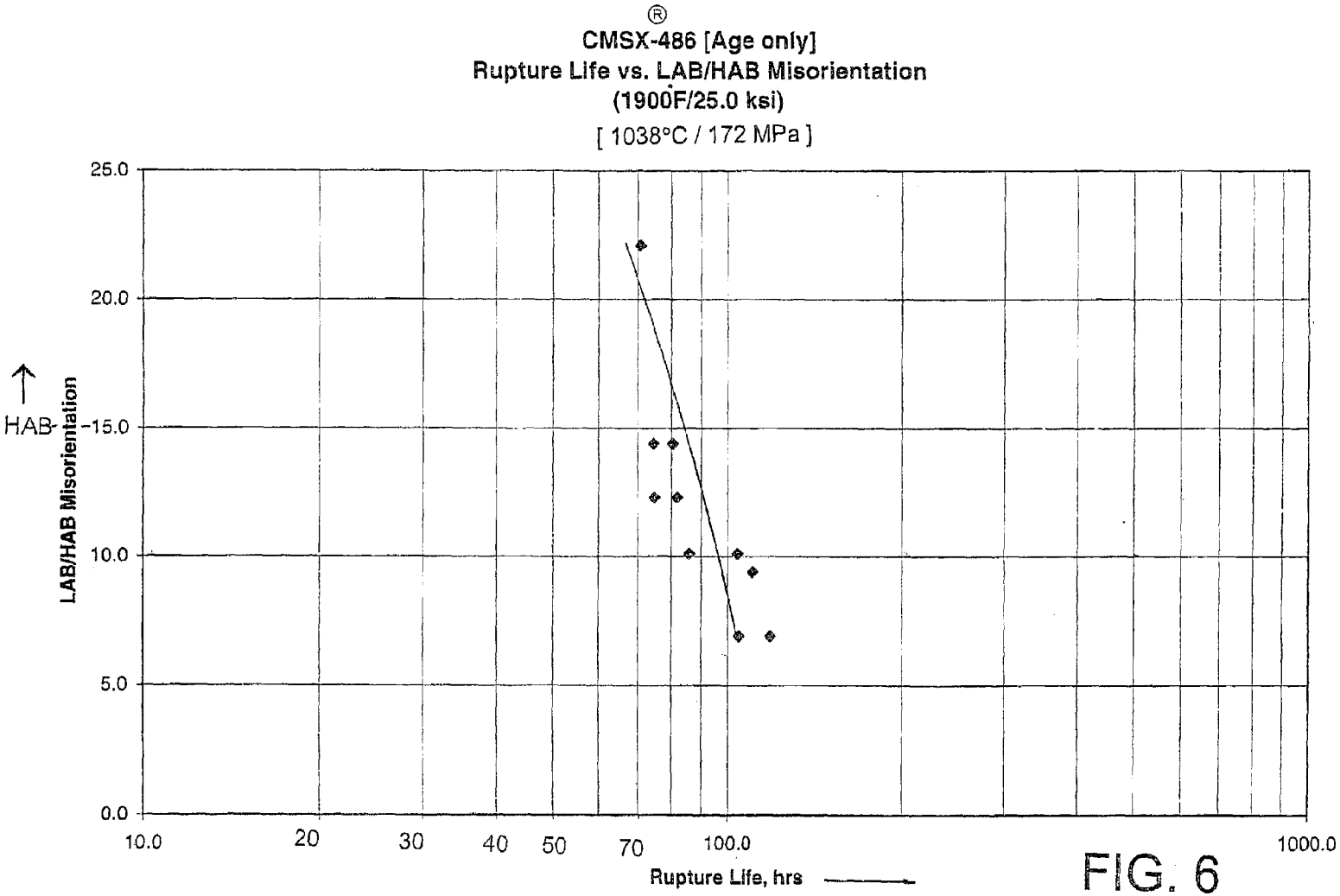
Figure 7:
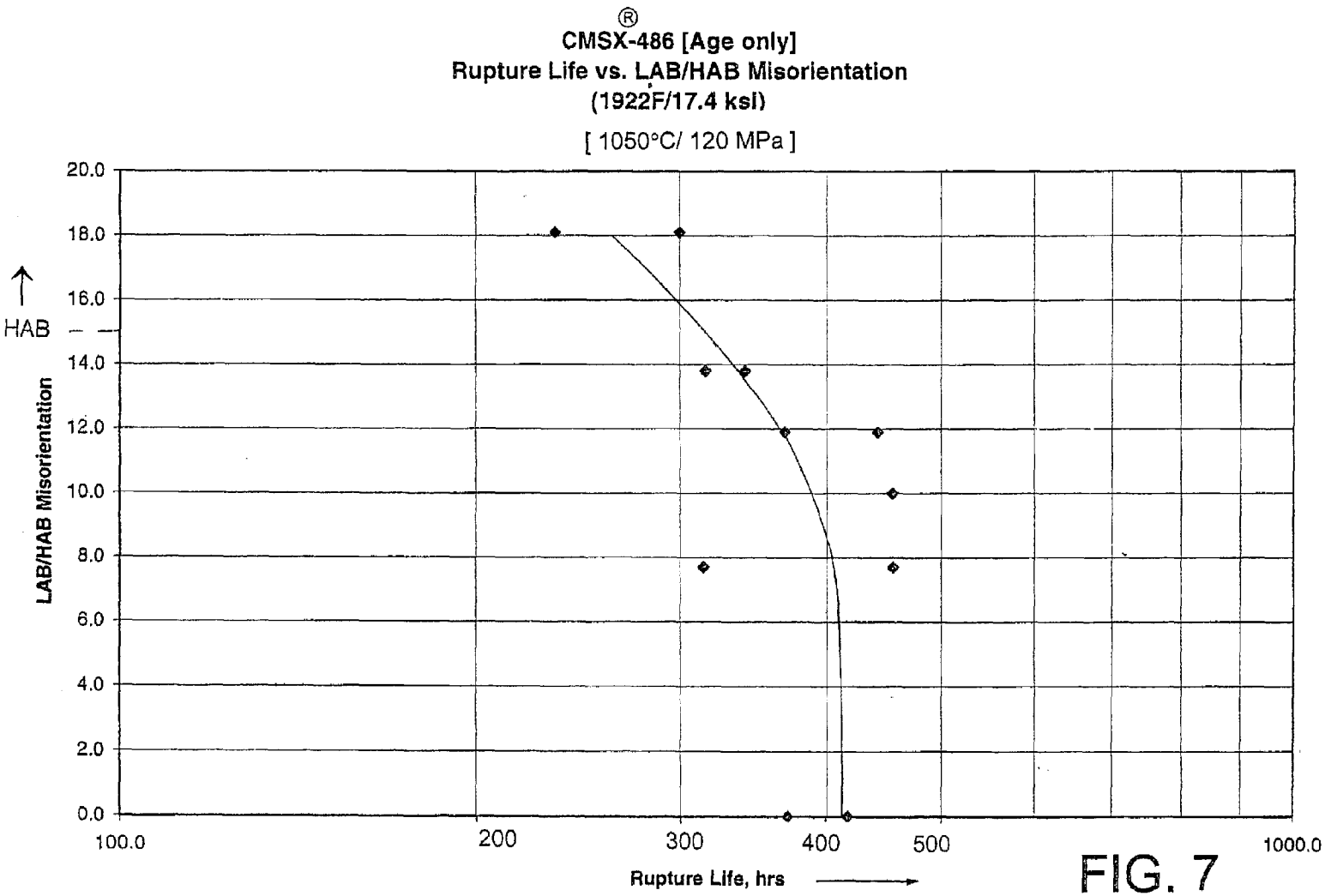
Figure 8:
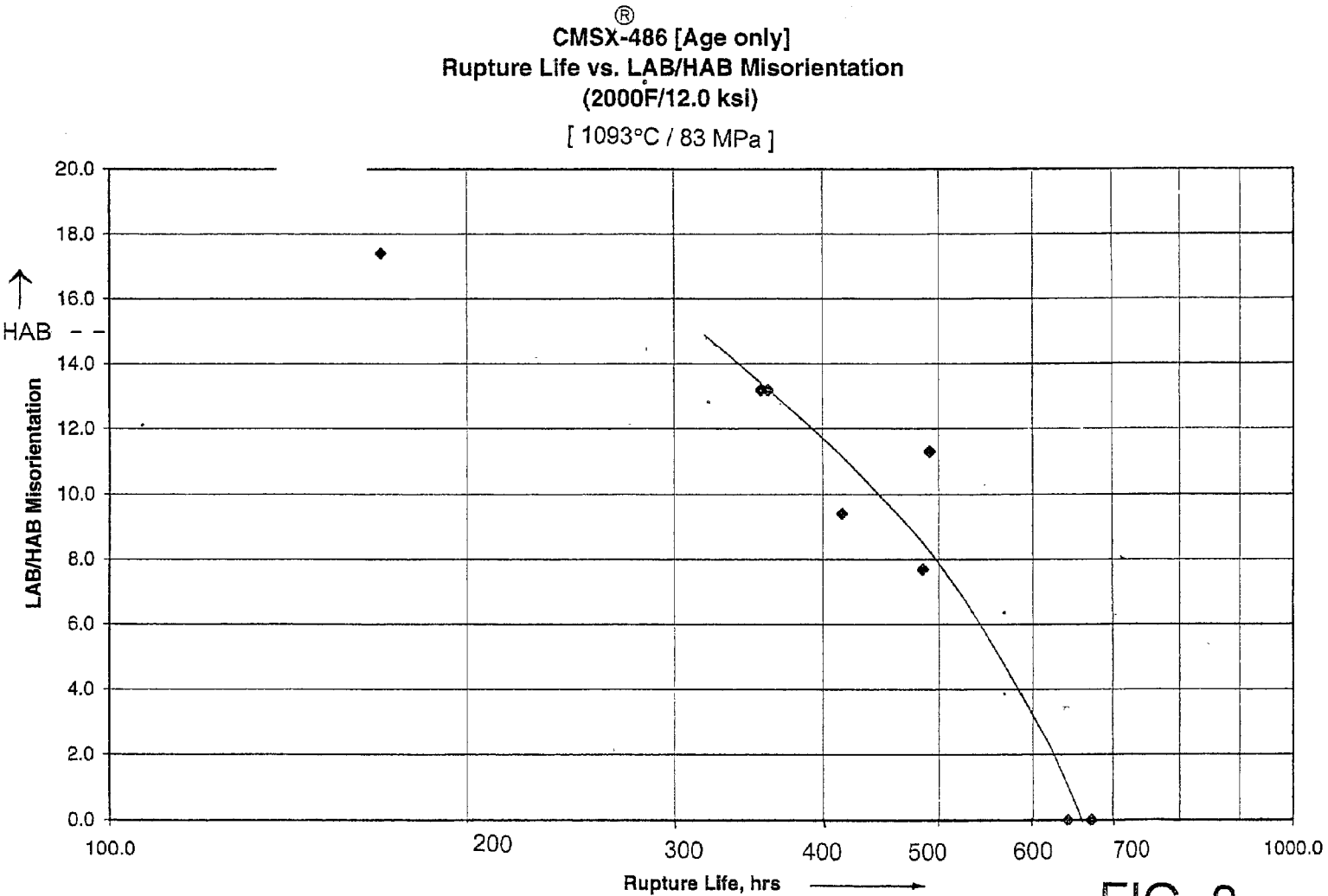

The results from Table 6 are also illustrated graphically in FIGS. 1–8. Each of FIGS. 1–8 is a graphical representation of low angle grain boundary (LAB) or high angle grain boundary (HAB) present/misorientation (degrees) verses stress-rupture life (hours) under a selected constant temperature and constant load condition. Each of the data points from Table 6 are indicated in FIGS. 1–8 by a solid diamond shape. FIGS. 1 and 2 show that the degree of LAB/HAB misorientation has very little effect on rupture life at 1742° F. and 30 ksi, and at 1742° F. and 36 ksi. The curves represented by a solid line in FIGS. 1–8 are intended to approximate a least squares fit of the data. FIG. 3 shows that LAB/HAB misorientation has a negligible effect on rupture life up to 10 degrees, and even at a misorientation of 18 degrees the rupture life is still about half that of a single crystal without a grain defect (0.0 degree LAB/HAB misorientation). This compares very favorably with the results for CMSX-3® (data points indicated by crosses), wherein a sharp decrease in rupture life occurs at a misorientation angle of about 6 degrees. Also noteworthy is that the single crystal (0.0 degree LAB/HAB misorientation) CMSX®-486 test slabs had a higher rupture life than the single crystal CMSX-3® test slabs. Further, the CMSX-3® data show a negative slope from 0.0 degrees to 6 degrees, whereas the rupture life of CMSX®-486 is nearly constant up to about 6 degrees. FIG. 4 shows that under conditions of 1800° F. and 25 ksi, LAB/HAB misorientation has very little effect on rupture life up to 18 degrees. FIG. 5 shows a similar result at 1800° F. and 30 ksi. FIG. 5 also shows that CMSX®-486 alloy provides more durable single crystal castings containing grain defects than René N-4 alloy (an alloy developed by General Electric and described in the following publication: "Rene N-4: A First Generation Single Crystal Turbine Airfoil Alloy With Improved Oxidation Resistance, Low Angle Boundary Strength and Superior Long Time Rupture Strength," Earl Ross et al., [GE Aircraft Engines] 8th Int. Symp. Superalloys, Proc, TMS, Seven Springs, Pa., United States of America, 22–26, September 1996) over the entire range of LAB/HAB misorientation under test conditions of 1800° F. and 30 ksi. Most notably, rupture life drops off very sharply above about 11 degrees for the René N-4 alloy, whereas rupture life is substantially unchanged over the entire range of LAB/HAB misorientation from 0.0 degrees to 18.0 degrees. FIG. 6 shows that test slabs subjected to 1900° F. and 25 ksi load exhibit only a relatively gradual reduction in rupture life up to a misorientation of about 22 degrees. FIGS. 7 and 8 show that even at conditions of 1922° F./17.4 ksi and 2000° F./12.0 ksi, respectively, the CMSX®-486 test slabs do not exhibit the sharp reduction in rupture life that is characteristic of other utilized single crystal alloy castings.

It is believed that the superior properties of nickel-base superalloy of this invention (e.g., CMSX®-486) is attributable relatively fine adjustments in the nominal chemistry as compared with an alloy such as CM 186 LC®. Specifically, it is believed that the increased tantalum (Ta) content of the alloys of this invention provide increased strength (e.g., improved stress-rupture and improved creep-rupture properties), and a reduced hafnium (Hf) content prevents excessive γ/γ' eutectic phase. The higher tantalum content is accommodated by a decrease in chromium to provide phase stability.

FIGS. 9, 10 and 11 show the typical microstructure of CMSX®-486 (as-cast) double aged (1975° F. for 4 hours, air-cooled, 1600° F. for 20 hours, air-cooled). FIGS. 9–11 are optical micrographs at a magnification of 100×, 200×, and 400×, respectively. FIGS. 9–11 show that the as-cast CMSX®-486 have about 5% volume fraction ($V_f$) eutectic phase (the lighter shaded areas). High $V_f$ of eutectic phase results in poor ductility.

Figure 12:
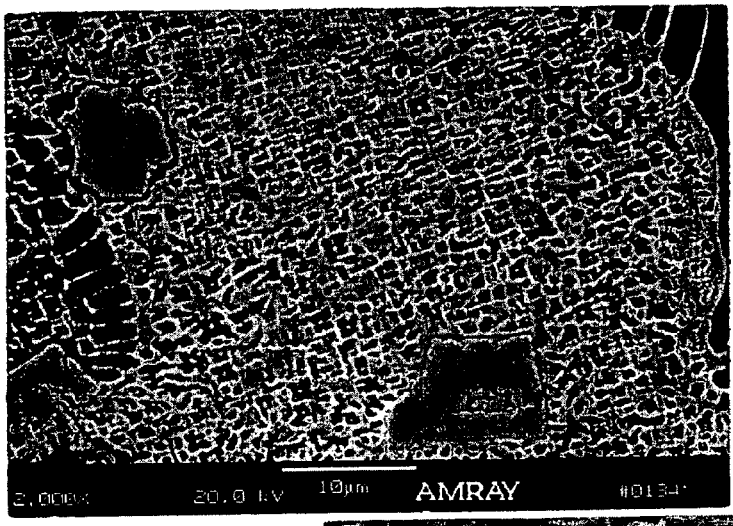
FIGS. 12–14 are electron micrographs of single crystal as-cast alloy of this invention.
Figure 13:
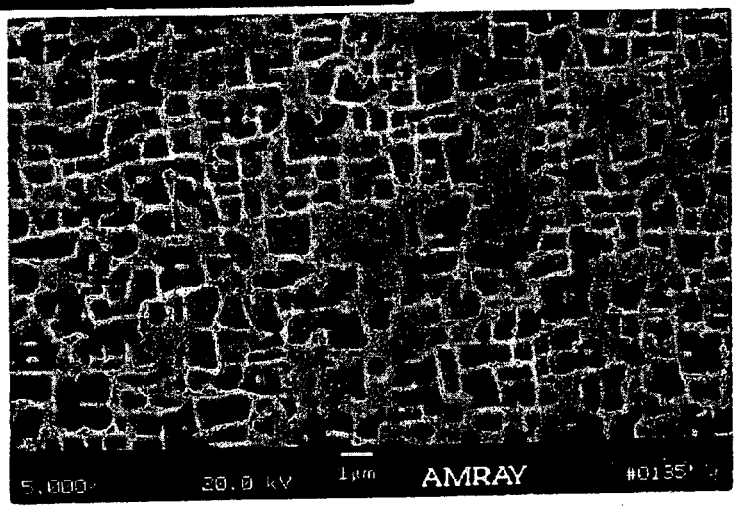
Figure 14:
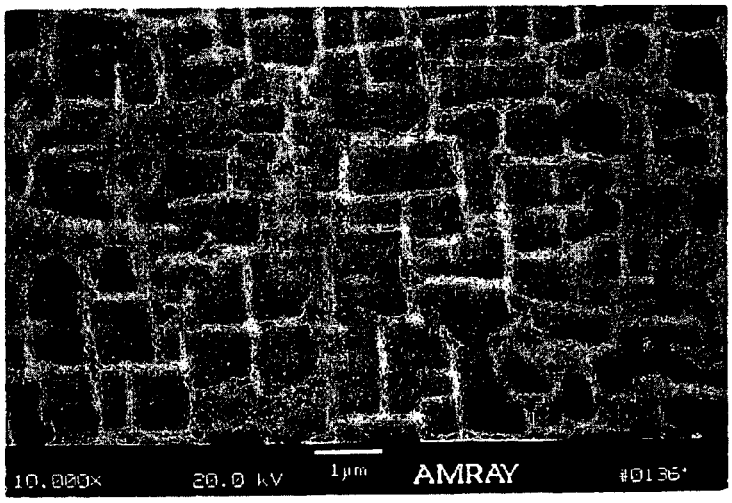

FIGS. 12–14 are electron micrographs of CMSX®-486 (as-cast) double aged (1975° F. for 4 hours, air-cooled, 1600° F. for 20 hours, air-cooled). The electron micrographs of FIGS. 12–14 are at a magnification of 2,000×, 5,000× and 10,000×, respectively, and show the ordered cubic γ' phase for the CMSX®-486 alloy as-cast. This is consistent with the excellent creep-rupture properties of CMSX®-486 castings. FIG. 12 also shows that carbides formed during solidification remain in good condition (i.e., do not exhibit degeneration).

Figure 15:
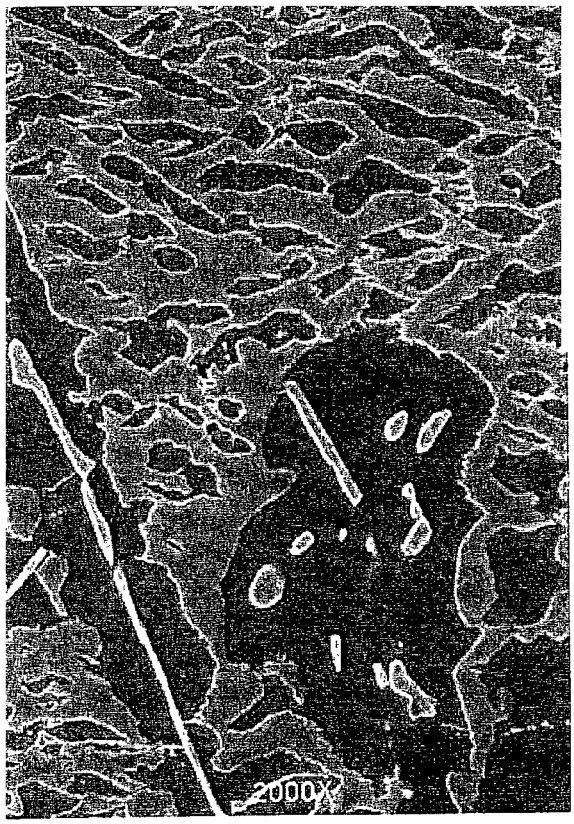
FIGS. 15–18 are SEM photomicrographs of nickel-based superalloys of this invention.
Figure 16:
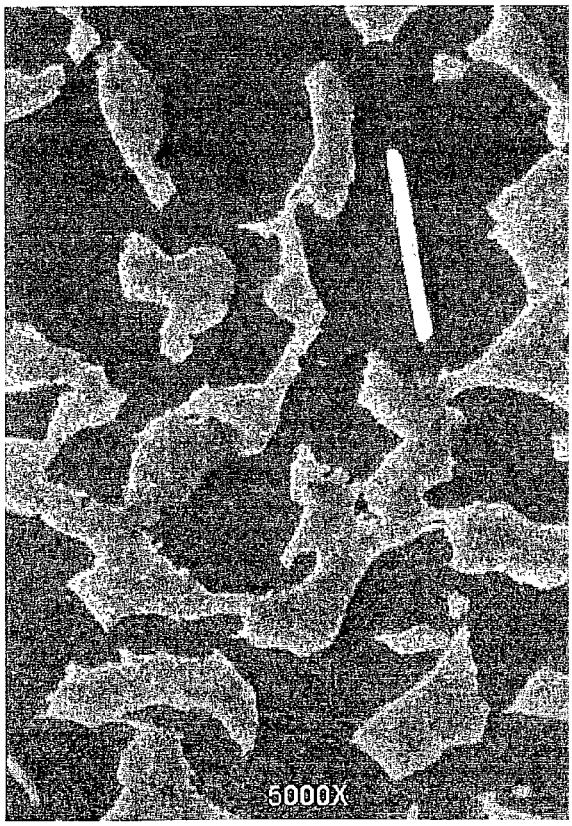

FIGS. 15 and 16 are SEM photomicrographs showing a fracture area of CMSX®-486 (1900° F. at 9298.0 hours at 9.0 ksi) at a magnification of 2000× and 5000× respectively. FIGS. 15 and 16 show a substantially reduced TCP phase (Re, W, Cr, rich) in the CMSX®-486 as compared with known nickel-based superalloys.

Figure 17:
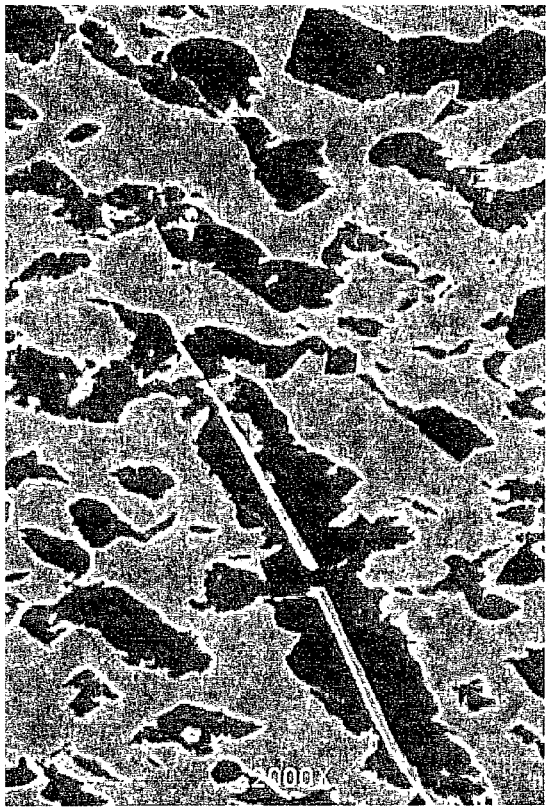
Figure 18:
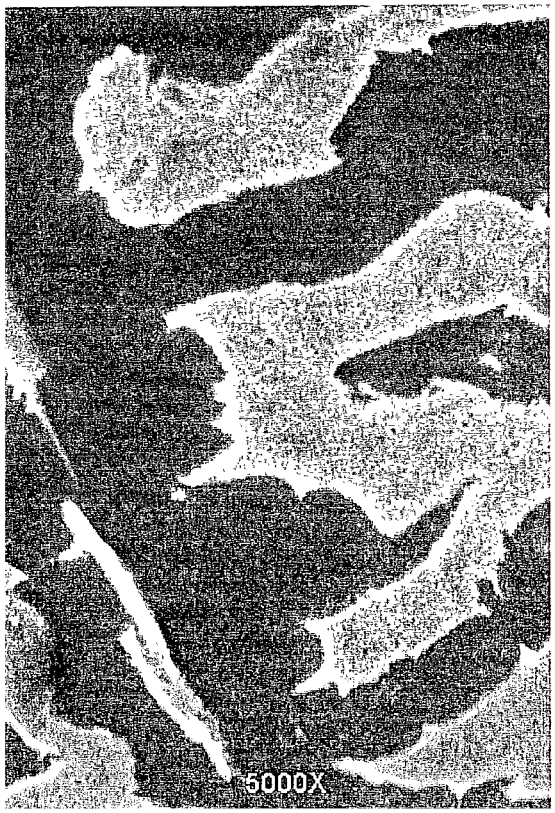

FIGS. 17 and 18 are SEM photomicrographs showing a fracture area of CMSX®-486 (2000° F. at 8805.5 hours at 6.0 ksi) at a magnification of 2000× and 5000× respectively. FIGS. 17 and 18 show a substantially reduced TCP phase (Re, W, Cr, rich) in the CMSX®-486 as compared with known nickel-based superalloys.

Figure 19:
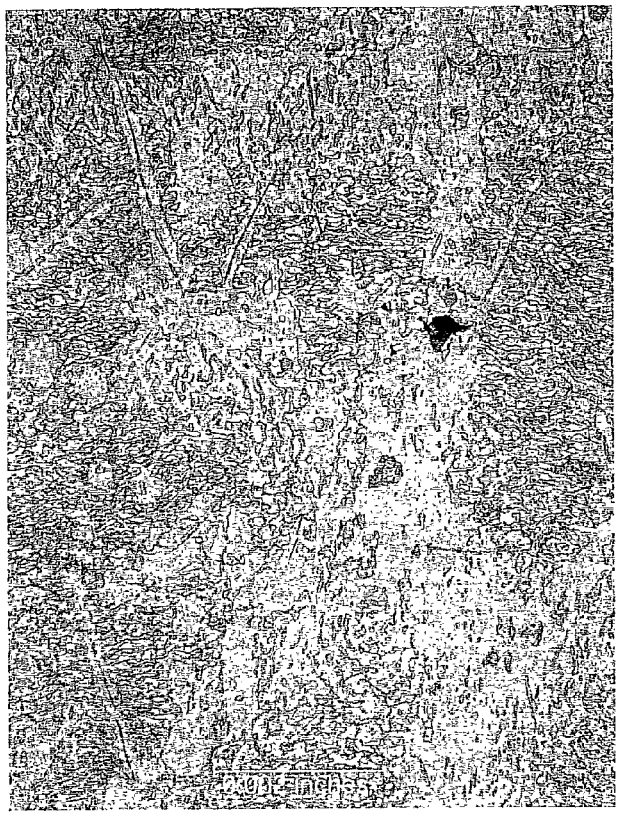
FIGS. 19–22 are optical photomicrographs of nickel-based superalloys of this invention.
Figure 20:
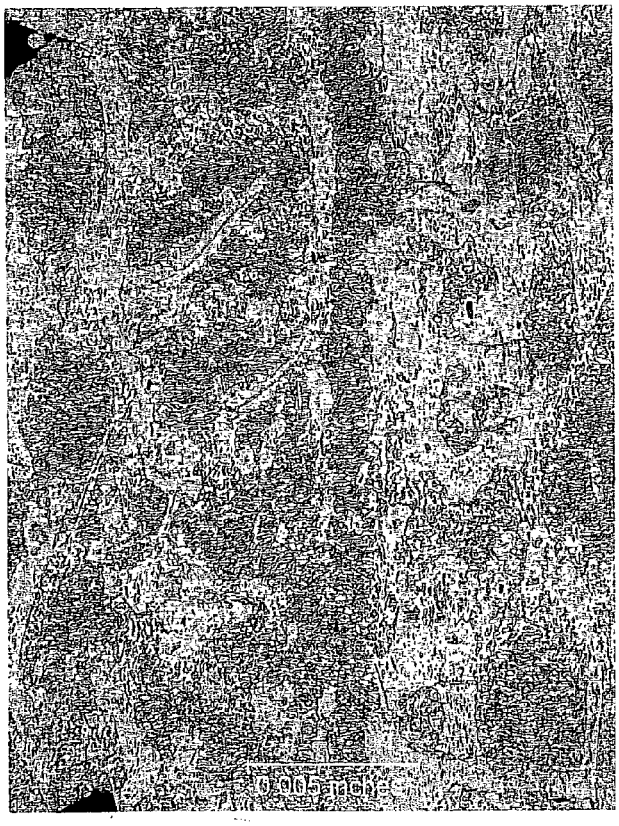

FIGS. 19 and 20 are optical photomicrographs showing a fracture area of CMSX®-486 (1900° F. at 9298.0 hours at 9.0 ksi) at a magnification of 2000× and 5000× respectively. FIGS. 19 and 20 show a substantially reduced TCP phase (Re, W, Cr, rich) in the CMSX®-486 as compared with known nickel-based superalloys.

Figure 21:
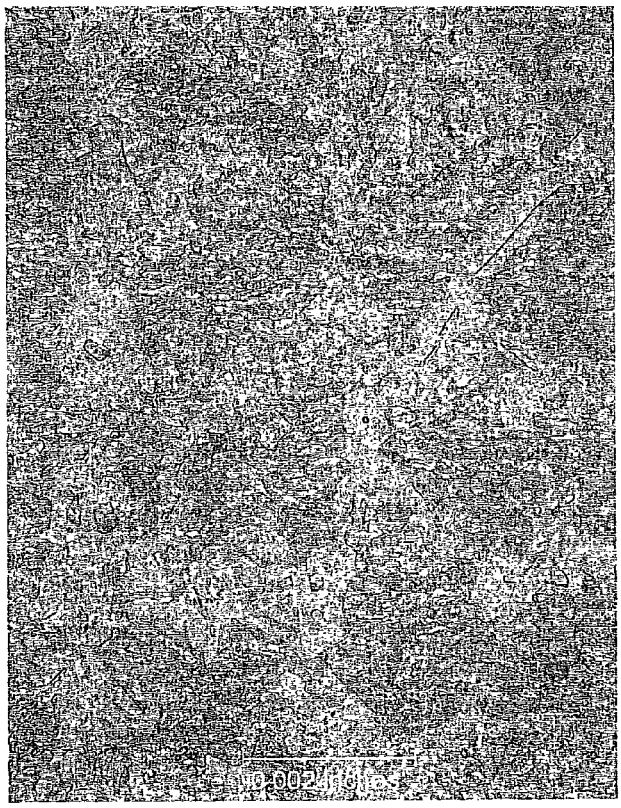
Figure 22:
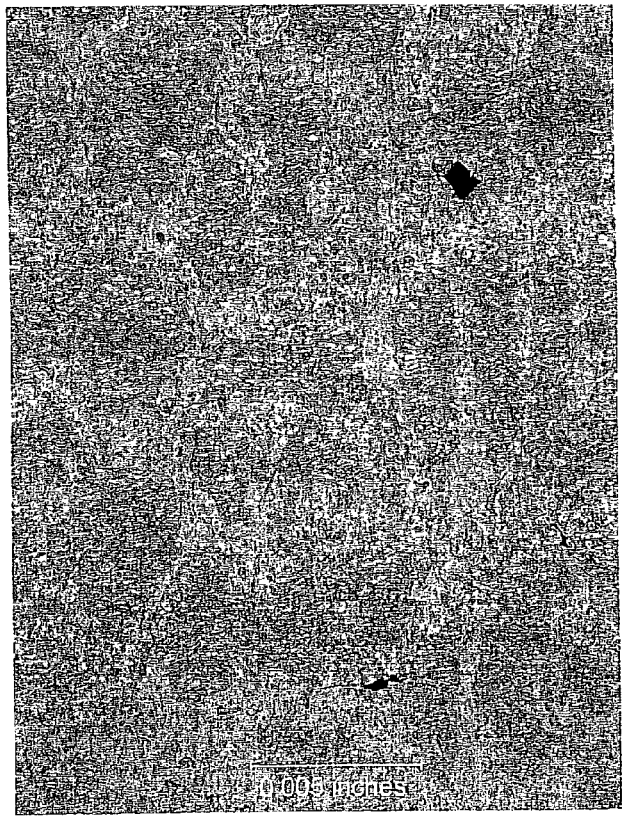

FIGS. 21 and 22 are optical photomicrographs showing a fracture area of CMSX®-486 (2000° F. 8805.5 hours at 6.0 ksi) at a magnification of 2000× and 5000× respectively. FIGS. 21 and 22 show a substantially reduced TCP phase (Re, W, Cr, rich) in the CMSX®-486 as compared with known nickel-based superalloys.

The alloys of this invention characteristically exhibit improved creep-strength as compared with conventional single crystal casting alloys, and an exceptional capacity for accommodating grain defects. Additionally, the nickel-based superalloys of this invention further exhibit a reduced amount of TCP phase (Re, W, Cr, rich) in the alloy following high temperatures, long term, stressed exposure without adversely affecting alloy properties, such as hot corrosion resistance, as compared with known conventional nickel-based superalloys. As a result, the alloys of this invention can be very beneficially employed to provide improved casting yield and reduced component cost for aircraft and industrial turbine components such as turbine vanes, blades, and multiple vane segments.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A nickel-base superalloy comprising, in percentages by weight, from about 4.7% to 4.9% chromium, (Cr), from about 9.0% to about 10.0% cobalt (Co), from about 0.6% to about 0.8% molybdenum (Mo), from about 8.4% to about 8.8% tungsten (W), from about 4.3% to about 4.8% tantalum (Ta), from about 0.6% to about 0.8% titanium (Ti), from about 5.6% to about 5.8% aluminum (Al), from about 2.8% to about 3.1% rhenium (Re), from about 1.1% to about 1.5% hafnium (Hf), from about 0.06% to about 0.08% carbon (C), from about 0.012% to about 0.020% boron (B), from about 0.004% to about 0.010% zirconium (Zr), the balance being nickel and incidental impurities.

2. The nickel-base superalloy of claim 1, wherein the tantalum is present in an amount of from about 4.4% to about 4.7% by weight.

3. The nickel-base superalloy of claim 1, wherein the total content of tungsten, rhenium, tantalum and molybdenum is from about 16.4% to about 17.0% by weight.

4. The nickel-base superalloy of claim 1 comprising, in percentages by weight, about 4.8% chromium, about 9.2–9.3% cobalt, about 0.7% molybdenum, about 8.5–8.6% tungsten, about 4.5% tantalum, about 0.7% titanium, about 5.6–5.7% aluminum, about 2.9% rhenium, about 1.2–1.3% hafnium, about 0.07–0.08% carbon, about 0.015–0.016% boron, about 0.005% zirconium, the balance being nickel and incidental impurities.

5. A single crystal casting prepared from a nickel-base superalloy comprising, in percentage by weight, from about 4.7% to 4.9% chromium, (Cr), from about 9.0% to about 10.0% cobalt (Co), from about 0.6% to about 0.8% molybdenum (Mo), from about 8.4% to about 8.8% tungsten (W), from about 4.3% to about 4.8% tantalum (Ta), from about 0.6% to about 0.8% titanium (Ti), from about 5.6% to about 5.8% aluminum (Al), from about 2.8% to about 3.1% rhenium (Re), from about 1.1% to about 1.5% hafnium (Hf), from about 0.06% to about 0.08% carbon (C), from about 0.012% to about 0.020% boron (B), from about 0.004% to about 0.010% zirconium (Zr), the balance being nickel and incidental impurities.

6. The single crystal casting of claim 5, wherein the tantalum is present in an amount of from about 4.4% to about 4.7% by weight.

7. The single crystal casting of claim 5, wherein the total content of tungsten, rhenium, tantalum and molybdenum is from about 16.4% to about 17.0% by weight.

8. The single crystal casting of claim 5, where 10–50 ppm La, Y, Ce individually or in combination is present to improve bare oxidation resistance and coating performance.

9. A nickel-base turbine vane, turbine blade, or multiple turbine vane segment cast from a nickel-base superalloy comprising, in percentage by weight, from about 4.7% to 4.9% chromium, (Cr), from about 9.0% to about 10.0% cobalt (Co), from about 0.6% to about 0.8% molybdenum (Mo), from about 8.4% to about 8.8% tungsten (W), from about 4.3% to about 4.8% tantalum (Ta), from about 0.6% to about 0.8% titanium (Ti), from about 5.6% to about 5.8% aluminum (Al), from about 2.8% to about 3.1% rhenium (Re), from about 1.1% to about 1.5% hafnium (Hf), from about 0.06% to about 0.08% carbon (C), from about 0.012% to about 0.020% boron (B), from about 0.004% to about 0.010% zirconium (Zr), the balance being nickel and incidental impurities.

10. The turbine vane, turbine blade, or multiple turbine vane segment of claim 9, wherein the tantalum is present in an amount of from about 4.4% to about 4.7% by weight.

* * * * *